US007802972B2

(12) United States Patent
Shimizu et al.

(10) Patent No.: US 7,802,972 B2
(45) Date of Patent: Sep. 28, 2010

(54) ROTARY TYPE COMPRESSOR

(75) Inventors: Takashi Shimizu, Osaka (JP); Yoshitaka Shibamoto, Osaka (JP); Kazuhiro Furusho, Osaka (JP); Kazutaka Hori, Osaka (JP); Takazo Sotojima, Osaka (JP); Masanori Masuda, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 83 days.

(21) Appl. No.: 11/911,752

(22) PCT Filed: Apr. 4, 2006

(86) PCT No.: PCT/JP2006/307096

§ 371 (c)(1),
(2), (4) Date: Oct. 17, 2007

(87) PCT Pub. No.: WO2006/114990

PCT Pub. Date: Nov. 2, 2006

(65) Prior Publication Data

US 2009/0148325 A1 Jun. 11, 2009

(30) Foreign Application Priority Data

Apr. 20, 2005 (JP) ..... 2005-122736

(51) Int. Cl.
*F04B 17/00* (2006.01)
*F16K 15/16* (2006.01)

(52) U.S. Cl. ..... 417/410.3; 137/856

(58) Field of Classification Search ..... 417/410.3, 417/410.5; 137/543.21, 855, 856; 415/416
See application file for complete search history.

(56) References Cited

U.S. PATENT DOCUMENTS 5,554,016 A * 9/1996 Sasano et al. ..... 417/569

FOREIGN PATENT DOCUMENTS

| | | | |
|---|---|---|---|
| JP | 56-47966 | U | 11/1981 |
| JP | 59-86389 | U | 6/1984 |
| JP | 59-189968 | U | 12/1984 |
| JP | 60-90584 | U | 6/1985 |
| JP | 62-243984 | A | 10/1987 |
| JP | 3-87886 | U | 9/1991 |
| JP | 2003-328965 | A | 11/2003 |
| JP | 2004-324485 | A | 11/2004 |

* cited by examiner

*Primary Examiner*—Devon C Kramer
*Assistant Examiner*—Bryan Lettman
(74) *Attorney, Agent, or Firm*—Global IP Counselors

(57) ABSTRACT

A valve guard for restricting the amount of deformation of a valve disc has a main body part abuttable with the back surface of the valve disc, and a fixation part extending to outside of a receding part. Upon mounting the valve guard to an end plate part, the fixation part is firmly attached to the outside of the receding part of the end plate part.

16 Claims, 10 Drawing Sheets

ROTARY TYPE COMPRESSOR

CROSS-REFERENCE TO RELATED APPLICATIONS

This U.S. National stage application claims priority under 35 U.S.C. §119(a) to Japanese Patent Application No. 2005-122736, filed in Japan on Apr. 20, 2005, the entire contents of which are hereby incorporated herein by reference.

TECHNICAL FIELD

The present invention relates to rotary type compressors configured to compress a fluid in a compression chamber composed of a movable member and a fixed member.

BACKGROUND ART

Rotary type compressors have been known in the past in which the discharge valve, for opening and closing a discharge passage in fluid communication with a compression chamber, is formed using a reed valve. This type of discharge valve is made up of a valve disc of plate shape and a valve guard for restricting the amount of deformation of the valve disc, and is set on the back surface side of an end plate part whose front surface faces the compression chamber. The valve disc is disposed along the back surface of the end plate part. The valve guard is disposed on the back surface side of the valve disc.

In a rotary type compressor which employs a discharge valve of the aforesaid type, the discharge passage becomes a dead volume (that is, the fluid which has not been discharged stays therein in the process of compression). To cope with this, it is preferred that the length of the discharge passage be as short as possible. However, if in order to reduce the length of the discharge passage, the peripheral thickness of the discharge passage of the end plate part is reduced to form a receding part, this weakens the strength of the end plate part at the receding part. In this case, at the time when the compression chamber is in the low pressure state, the receding part deforms towards the compression chamber due to the difference in pressure between the compression chamber side and the discharge space side, thereby resulting in leakage of refrigerant from the compression chamber. This causes a problem that there is a drop in efficiency of the compressor. In addition, since the valve disc and the valve guard are firmly attached to the receding part of thin thickness by use of a bolt, this causes another problem that the receding part becomes distorted when tightening up the bolt.

JP-A-1987-243984 therefore discloses a rotary compressor with a discharge valve for providing solutions to the above-described drawbacks. Referring to FIG. 14, there is shown a cross sectional view of the discharge valve of the aforesaid patent document. In this rotary compressor, the receding part is formed on the back surface side of a bearing which is an end plate part whose front surface faces the compression chamber, and a discharge hole is opened at the bottom surface of the receding part. In the receding part, the wall surface on the side where a valve disc and a valve guard are mounted is an inclined surface. A bolt, used to firmly attach the valve disc and the valve guard to the inclined wall surface, is provided above a relatively thick portion of the inclined wall surface of the receding part.

SUMMARY OF THE INVENTION

Problems that the Invention Seeks to Overcome

In the conventional rotary type compressor, the thickness of the inclined surface portion of the receding part is greater than the thickness of the bottom surface portion of the receding part, but smaller than the thickness of the surrounding area of the receding part. This not only prevents the receding part from becoming distorted when tightening up the bolt, but also controls the aforesaid deformation of the receding part at the time when the compression chamber is in the low pressure state. However, the strength of the receding part still remains weak and its deformation becomes problematic.

with a view to overcoming the aforesaid problems, the present invention was devised. Accordingly, an object of the present invention is to reduce, in a rotary type compressor whose discharge valve is formed by a reed valve, the deformation of the end plate part taking place in the process of compressing fluid in the compression chamber.

Means for Overcoming the Problems

The present invention provides, as a first aspect, a compressor of the rotary type comprising a movable member (38) which moves in an eccentric motion and a fixed member (39) which cooperates with the movable member (38) to define a compression chamber (41, 42), wherein fluid drawn into the compression chamber (41, 42) by driving the movable member (38) is compressed. In the rotary type compressor of the first aspect: (a) the fixed member (39) has an end plate part (37) whose front surface faces the compression chamber (41, 42); (b) the end plate part (37) is provided with a receding part (25) formed on the back surface side thereof, a discharge passage (51, 52) fluidly communicating with the compression chamber (41, 42) and opening at the bottom surface of the receding part (25), and a discharge valve (21) formed by a reed valve and opening and closing the discharge passage (51, 52); (c) the discharge valve (21) has a valve disc (18) whose front surface abuts with the bottom surface of the receding part (25) and a valve guard (16) for restricting the amount of deformation of the valve disc (18); and (d) the valve guard (16), having a main body part (17) abuttable with the back surface of the valve disc (18) and a fixation part (19*a*) integrally formed with the main body part (17) and extending to outside of the receding part (25) along the back surface of the end plate part (37), is mounted to the end plate part (37) by fixation of the fixation part (19*a*) to the end plate part (37).

In addition, the present invention provides, as a second aspect, a compressor of the rotary type comprising: a cylinder (40) having a cylinder chamber (41, 42) of ring shape; a ring-shaped piston (45) arranged eccentrically with respect to the cylinder (40) and housed in the cylinder chamber (41, 42) whereby the cylinder chamber (41, 42) is divided into an outer cylinder chamber (41) and an inner cylinder chamber (42); a blade (46) disposed in the cylinder chamber (41, 42) and dividing the cylinder chamber (41, 42) into a first chamber (41*a*, 42*a*) and a second chamber (41*b*, 42*b*); and an end plate part (37) formed in one end part of either the cylinder (40) or the ring-shaped piston (45) and having a front surface facing the cylinder chamber (41, 42), wherein fluid in the cylinder chamber (41, 42) is compressed by relative eccentric rotation motion between the cylinder (40) and the ring-shaped piston (45). In the rotary type compressor of the second aspect: (a)

the end plate part (37) is provided with a receding part (25) formed on the back surface side thereof, a discharge passage (51, 52) fluidly communicating with the cylinder chamber (41, 42) and opening at the bottom surface of the receding part (25), and a discharge valve (21) formed by a reed valve and opening and closing the discharge passage (51, 52); (b) the discharge valve (21) has a valve disc (18) of plate shape whose front surface abuts with the bottom surface of the receding part (25) and a valve guard (16) for restricting the amount of deformation of the valve disc (18); (c) and the valve guard (16), having a main body part (17) abuttable with the back surface of the valve disc (18) and a fixation part (19*a*) integrally formed with the main body part (17) and extending to outside of the receding part (25) along the back surface of the end plate part (37), is mounted to the end plate part (37) by fixation of the fixation part (19*a*) to the end plate part (37).

The present invention provides, as a third aspect according to either the first or the second aspect, a rotary type compressor wherein the discharge valve (21) has a pin member (24) passing through the base end side of the valve disc (18) and restricting the movement of the valve disc (18).

The present invention provides, as a fourth aspect according to the third aspect, a rotary type compressor wherein there is defined between the valve guard (16) and the bottom surface of the receding part (25) a clearance gap for allowing the base end side of the valve disc (18) to move in the axial direction of the pin member (24).

The present invention provides, as a fifth aspect according to any one of the first to third aspects, a rotary type compressor wherein the base end side of the valve disc (18) is tucked between the valve guard (16) and the bottom surface of the receding part (25).

The present invention provides, as a sixth aspect according to either the first or the second aspect, a rotary type compressor wherein the valve disc (18) is folded back, at the base end side thereof, towards the back surface side and is tucked between the valve guard (16) and the wall surface of the receding part (25).

The present invention provides, as a seventh aspect according to any one of the first to sixth aspects, a rotary type compressor wherein the rotary type compressor is installed in a refrigerant circuit of a refrigeration apparatus which performs a refrigeration cycle, and wherein the rotary type compressor compresses carbon dioxide as a refrigerant with which the refrigerant circuit is charged.

Operation

In the first aspect of the present invention, the valve guard (16) for restricting the amount of deformation of the valve disc (18) has the main body part (17) capable of abutment with the back surface of the valve disc (18), and the fixation part (19*a*) extending to outside of the receding part (25). The valve guard (16) is mounted to the end plate part (37), with its fixation part (19*a*) firmly attached to the outside of the receding part (25) of the end plate part (37). Accordingly, in the first aspect of the present invention, there is no need to secure, within the receding part (25), a space for fixation of the valve guard (16).

In the second aspect of the present invention, the valve guard (16) for restricting the amount of deformation of the valve disc (18) has the main body part (17) capable of abutment with the back surface of the valve disc (18), and the fixation part (19*a*) extending to outside of the receding part (25). The valve guard (16) is mounted to the end plate part (37), with its fixation part (19*a*) firmly attached to the outside of the receding part (25) of the end plate part (37). Accordingly, in the second aspect of the present invention, there is no need to secure, within the receding part (25), a space for fixation of the valve guard (16).

In the third aspect of the present invention, the movement of the valve disc (18) is restricted by the pin member (24) passing through the base end side of the valve disc (18). The leading end side of the valve disc (18) is opened and closed, with the movement of the base end side thereof restricted by the pin member (24).

In the fourth aspect of the present invention, there is defined between the valve guard (16) and the bottom surface of the receding part (25) a clearance gap, thereby enabling the valve disc (18) to move in the axial direction of the pin member (24). In other words, it is arranged such that the outlet opening of the discharge passage (51, 52) is opened by movement of the valve disc (18) in the axial direction of the pin member (24). Accordingly, the amount of deformation of the valve disc (18) at the time when fluid is discharged out from the discharge passage (51, 52) can be restrained low.

In the fifth aspect of the present invention, the base end part of the valve disc (18) is tucked between the valve guard (16) and the bottom surface of the receding part (25), whereby the valve disc (18) is firmly attached to the end plate part (37). That is, by making utilization of the valve guard (16) and the bottom surface of the receding part (25), the valve disc (18) is firmly attached to the end plate part (37).

In the sixth aspect of the present invention, the leading end side of the valve disc (18) is in abutment with the bottom surface of the receding part (25) while the bent base end side is in abutment with the wall surface of the receding part (25). In this state, the base end side of the valve disc (18) is tucked between the valve guard (16) and the wall surface of the receding part (25) and becomes firmly fixed in place. In the sixth aspect of the present invention, the surface with which the leading end side of the valve disc (18) abuts is noncoplanar with the surface to which the base end side of the valve disc (18) is firmly attached. Accordingly, the movement of the valve disc (18) over the bottom surface of the receding part (25) with which the leading end side of the valve disc (18) abuts is restricted, thereby preventing the valve disc (18) from rotating.

In the seventh aspect of the present invention, the rotary type compressor compresses carbon dioxide either in the compression chamber (41, 42) or in the cylinder chamber (41, 42). Here, in the refrigeration cycle employing carbon dioxide as a refrigerant, there is an increase in the difference in pressure between the low pressure refrigerant drawn either into the compression chamber (41, 42) or into the cylinder chamber (41, 42) and the high pressure refrigerant discharged either from the compression chamber (41, 42) or from the cylinder chamber (41, 42). Therefore, in the seventh aspect of the present invention, when either the compression chamber (41, 42) or the cylinder chamber (41, 42) is in the low pressure state in the process of refrigerant compression, the difference in pressure occurring between either the compression chamber (41, 42) or the cylinder chamber (41, 42) and the discharge space side becomes greater than the case of use of a common Freon refrigerant.

ADVANTAGEOUS EFFECTS OF THE INVENTION

In the present invention, the fixation part (19*a*) of the valve guard (16) is set such that it extends to outside of the receding part (25). And the fixation part (19*a*) is firmly attached to the outside of the receding part (25) of the end plate part (37) whereby the valve guard (16) is mounted to the end plate part (37). This therefore eliminates the need for securing space for firm attachment of the valve guard (16) in the receding part (25), thereby making it possible to reduce the size of area of the receding part (25) of weaker strength as compared to the surrounding area. Accordingly, the deformation of the end plate part (37) taking place in the process of fluid compression in the compression chamber (41, 42) can be reduced, thereby making it possible to reduce leakage of refrigerant from the compression chamber (41, 42) associated with the deformation of the end plate part (37). Therefore, the efficiency of compression is improved in the rotary type compressor of the present invention.

In addition, in the fourth aspect of the present invention, the valve disc (18) is made able to move in the axial direction of the pin member (24) whereby the outlet opening of the discharge passage (51, 52) is opened by movement of the valve disc (18) in the axial direction of the pin member (24). Accordingly, the amount of deformation of the valve disc (18) when the fluid is discharged from the discharge passage (51, 52) is restrained low, thereby making it possible to reduce the loss of discharge pressure at that time. Now, therefore, the loss of overcompression when the fluid is discharged from the discharge passage (51, 52) can be reduced whereby the efficiency of compression is further improved in the rotary type compressor of the present invention.

In addition, in the fifth aspect of the present invention, the valve guard (16) and the bottom surface of the receding part (25) are utilized for firm attachment of the valve disc (18). Therefore, there is no need to provide any means for firm attachment of the valve disc (18) whereby the discharged valve (21) is structurally simplified.

In addition, in the sixth aspect of the present invention, the base end side of the valve disc (18) which is folded back towards the back surface is tucked between the valve guard (16) and the wall surface of the receding part (25) whereby the valve disc (18) is prevented from rotating. In accordance with the sixth aspect of the present invention, the base end side of the valve disc (18) is bent and the bent portion is firmly attached to the wall surface side of the receding part (25), only by which the valve disc (18) is prevented from rotating, without provision of any means to prevent the valve disc (18) from rotating. Therefore, there is no need to provide any means for preventing the valve disc (18) from rotating whereby the discharged valve (21) is structurally simplified.

In addition, in the seventh aspect of the present invention, when either the compression chamber (41, 42) or the cylinder chamber (41, 42) is in the low pressure state in the process of compressing carbon dioxide as a refrigerant, the difference in pressure occurring between either the compression chamber (41, 42) or the cylinder chamber (41, 42) and the discharge space side becomes greater than the case of use of a common Freon refrigerant. The size of area occupied by the receding part (25) in the end plate part (37) is conventionally great, so that if the rotary type compressor (10) is installed in a refrigerant circuit using carbon dioxide as a refrigerant, the amount of deformation of the end plate part (37) tends to increase due to the aforesaid pressure difference across the end plate part (37). On the other hand, in accordance with the rotary type compressor (10) of the present invention, the size of area of the receding part (25) becomes reduced, thereby enhancing the rigidity of the end plate part (37). Accordingly, the rotary type compressor (10) of the present invention is especially useful when installed in a refrigerant circuit using carbon dioxide as a refrigerant.

DETAILED DESCRIPTION OF THE INVENTION

In the following, preferred embodiments of the present invention will be described in detail with reference to the accompanying drawings.

First Embodiment of the Invention

Figure 1:
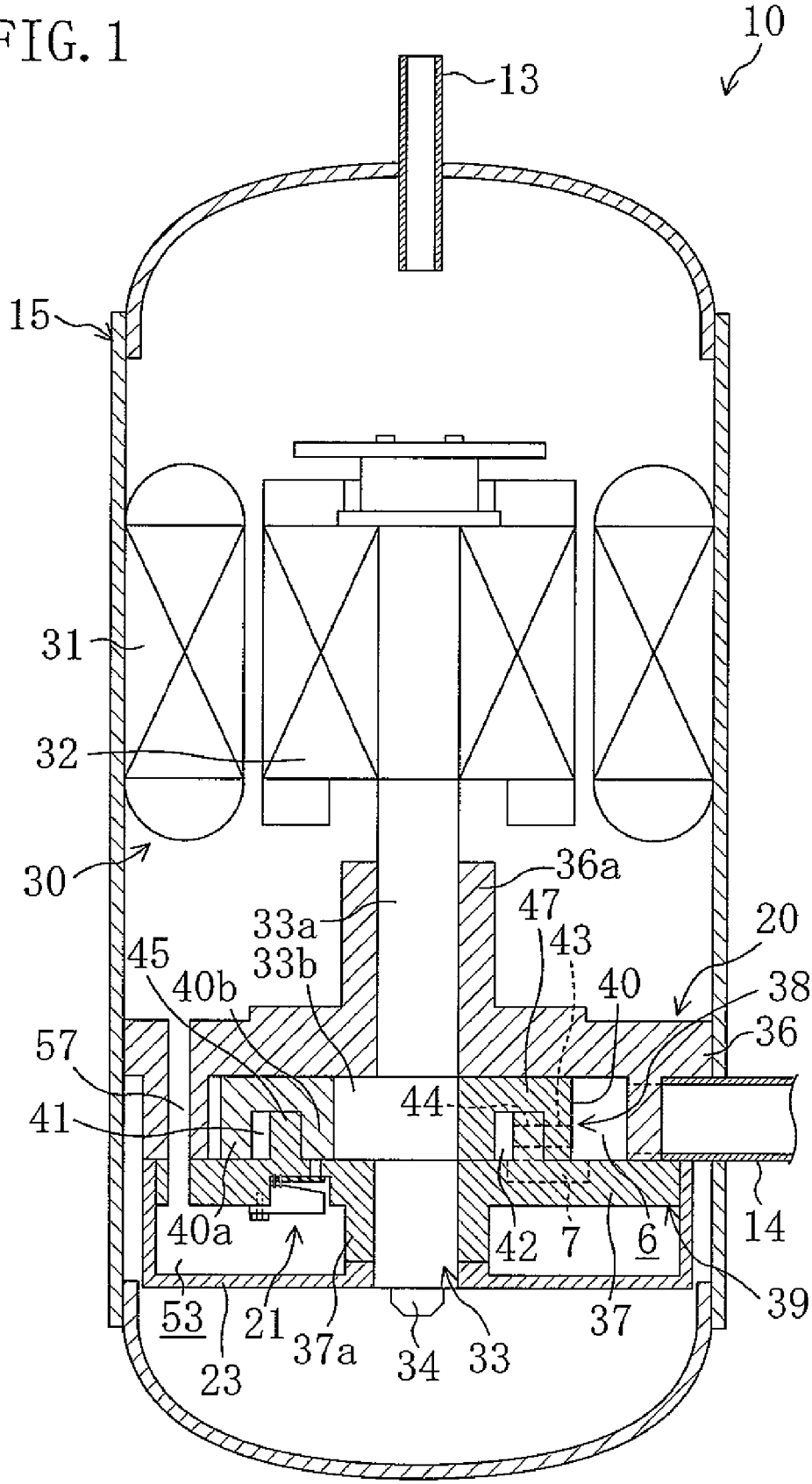
FIG. 1 is a longitudinal cross sectional view of a rotary type compressor according to a first embodiment of the present invention.

A first embodiment of the present invention is now described. Referring to FIG. 1, there is shown a longitudinal cross sectional view of a compressor (10) of the first embodiment. The compressor (10) of the first embodiment is a compressor of the rotary type in which the refrigerant in a cylinder chamber (41, 42) is compressed by relative eccentric rotation motion between a ring-shaped piston (45) and a cylinder (40) both of which will be hereinafter described. The rotary type compressor (10) is installed in a refrigerant circuit of a refrigeration apparatus which is charged with carbon dioxide as a refrigerant and which performs a vapor compression refrigeration cycle. The rotary type compressor (10) compresses refrigerant drawn in from the evaporator and then discharges it to the condenser. In this refrigerant circuit, the high pressure of the refrigeration cycle becomes equal to or higher than the critical pressure of carbon dioxide. Also note that the rotary type compressor (10) may be installed in another type of refrigerant circuit which uses, as a refrigerant, other than carbon dioxide.

The compressor (10) has a casing (15) which is a longitudinally long, cylinder-shaped, hermetical container. The casing (15) contains thereinside a compression mechanism (20) and an electric motor (30) wherein the compression mechanism (20) is positioned nearer the lower side while the electric motor (30) is positioned nearer the upper side.

The casing (15) is provided with a suction pipe (14) which runs through its body side. The suction pipe (14) is connected to the compression mechanism (20). In addition, the casing (15) is provided with a discharge pipe (13) which runs through its top side. The discharge pipe (13) has an inlet opening which opens to a space above the electric motor (30).

The casing (15) contains thereinside a crank shaft (33) which extends in an up and down direction. The crank shaft (33) has a main shaft part (33*a*) and an eccentric part (33*b*). The eccentric part (33*b*) is positioned nearer the lower end of the crank shaft (33) and is shaped like a circular cylinder of greater diameter than that of the main shaft part (33*a*). The axial center of the eccentric part (33*b*) is off-centered by a given amount from that of the main shaft part (33*a*).

The compression mechanism (20) has a movable member (38) which moves in an eccentric motion and a fixed member (39) which cooperates with the movable member (38) to form a compression chamber (41, 42) to be hereinafter described. The movable member (38) has a cylinder (40) and a blade (46). The cylinder (40) and the blade (46) are formed integrally with each other. The fixed member (39) has a ring-shaped piston (45), a lower housing (37) of circular plate shape which is an end plate part, and an upper housing (36) of circular plate shape. The ring-shaped piston (45) and the lower housing (37) are formed integrally with each other. The cylinder (40) is tucked between the upper housing (36) and the lower housing (37) for the compression mechanism (20) to become integral therewith, whereby the compression mechanism (20) is firmly attached, at the outer periphery of the upper housing (36), to the casing (15).

The cylinder (40) has an outer cylinder (40*a*) and an inner cylinder (40*b*). The outer cylinder (40*a*) and the inner cylinder (40*b*) are connected together at their upper portions by a coupling member (47) so that they become integral with each other. The coupling member (47) is formed at one end part (upper side) of the ring-shaped piston (45), and faces a cylinder chamber (41, 42) to be hereinafter described.

Figure 2:
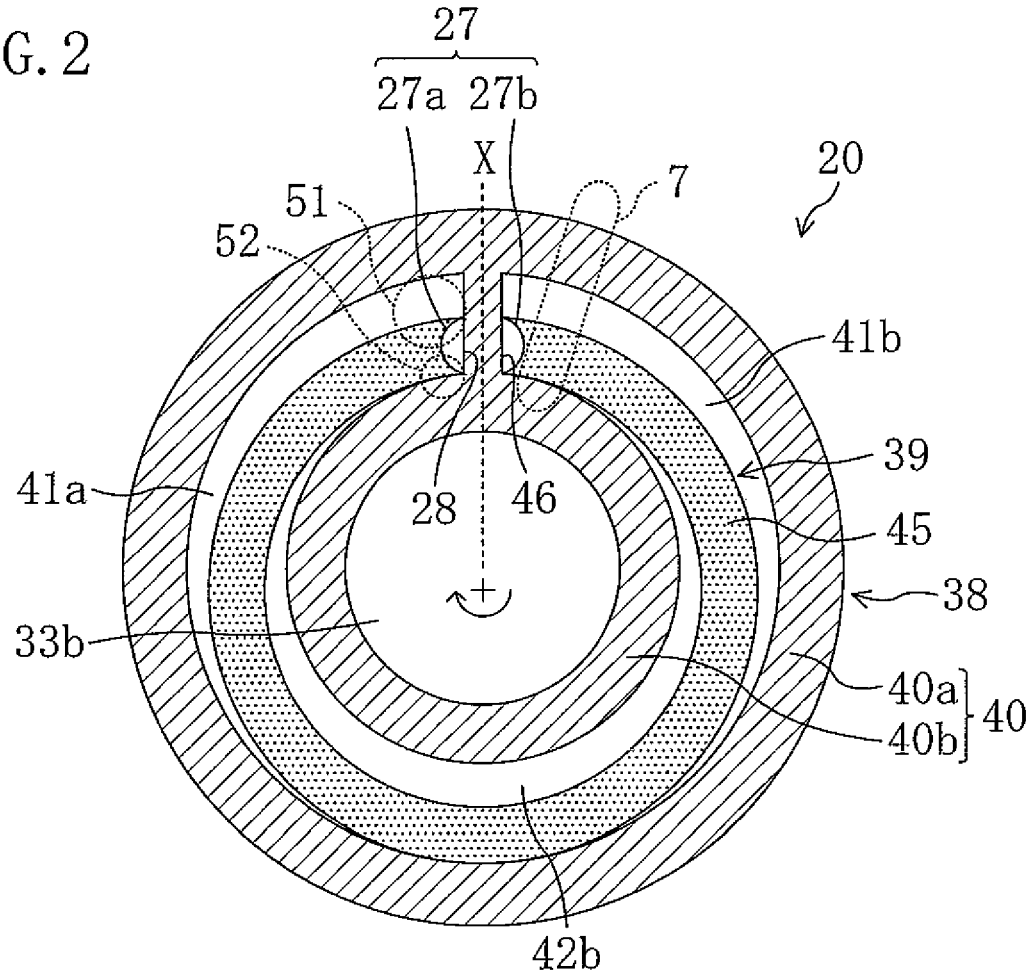
FIG. 2 is a transverse cross sectional view of a compression mechanism of the rotary type compressor of the first embodiment.

As shown in FIG. 2, the outer cylinder (40*a*) and the inner cylinder (40*b*) are each formed into a respective circular ring shape. The inner peripheral surface of the outer cylinder (40*a*) and the outer peripheral surface of the inner cylinder (40*b*) are cylindrical surfaces which are arranged coaxially with each other. Formed between the inner peripheral surface of the outer cylinder (40*a*) and the outer peripheral surface of the inner cylinder (40*b*) is the ring-shaped cylinder chamber (41, 42).

The ring-shaped piston (45) is formed such that it has the shape of a C, i.e., a circular ring shape with a portion thereof cut away. The ring-shaped piston (45) has an outer peripheral surface of smaller diameter than that of the inner peripheral surface of the outer cylinder (40*a*) and has an inner peripheral surface of greater diameter than that of the outer peripheral surface of the inner cylinder (40*b*). The ring-shaped piston (45) is accommodated, in an off-centered state with respect to the cylinder (40), in the cylinder chamber (41, 42). Consequently, the ring-shaped piston (45) divides the cylinder chamber (41, 42) into an inner side and an outer side. Defined between the outer peripheral surface of the ring-shaped piston (45) and the inner peripheral surface of the outer cylinder (40*a*) is an outer cylinder chamber (41) which is a compression chamber. On the other hand, defined between the inner peripheral surface of the ring-shaped piston (45) and the outer peripheral surface of the inner cylinder (40*b*) is an inner cylinder chamber (42) which is a compression chamber.

The arrangement for the ring-shaped piston (45) and the cylinder (40) is such that the outer peripheral surface of the ring-shaped piston (45) and the inner peripheral surface of the outer cylinder (40*a*) substantially come into contact with each other at one point (technically, there is a clearance gap of micron order therebetween, but the leakage of refrigerant in the clearance gap is negligible) while, at a position which differs in phase by 180 degrees from the contact point the inner peripheral surface of the ring-shaped piston (45) and the outer peripheral surface of the inner cylinder (40*b*) substantially come into contact with each other at one point.

The eccentric part (33*b*) of the crank shaft (33) is slidably engaged into the inner peripheral surface of the inner cylinder (40*b*). In the rotary type compressor (10) of the present first embodiment, it is configured such that the cylinder (40) which constitutes the movable member (38) moves in an eccentric rotation motion whereby the ring-shaped piston (45) which constitutes the fixed member (39) and the cylinder (40) rotate relatively with each other.

The blade (46) is configured such that it is inserted through the cutaway portion of the ring-shaped piston (45) and extends in the radial direction of the cylinder chamber (41, 42) from the inner peripheral surface of the outer cylinder (40*a*) to the outer peripheral surface of the inner cylinder (40*b*). The blade (46) is firmly attached to the inner peripheral surface of the outer cylinder (40*a*) and to the outer peripheral surface of the inner cylinder (40*b*). Consequently, the blade (46) divides each cylinder chamber (41, 42) into a high pressure chamber (41*a*, 42*a*) which is a first chamber and a low pressure chamber (41*b*, 42*b*) which is a second chamber.

In the cutaway portion of the ring-shaped piston (45) (i.e., in the opening portion (removed portion) of the ring-shaped piston having a C shape) in the compression mechanism (20), a swinging bush (27) is provided by which the ring-shaped piston (45) and the blade (46) are coupled movably with each other. The swinging bush (27) is made up of a discharge side bush (27*a*) which is positioned, in relation to the blade (46), on the side of the high pressure chamber (41*a*, 42*a*), and a suction side bush (27*b*) which is positioned, in relation to the blade (46), on the side of the low pressure chamber (41*b*, 42*b*). Both the discharge side bush (27*a*) and the suction side bush (27*b*) are formed such that they are identical in shape having a cross section of approximately semicircle shape, and that they are arranged such that their flat surfaces face each other. And the space between the opposing flat surfaces of the bushes (27*a*, 27*b*) constitutes a blade groove (28).

The blade (46) is inserted into the blade groove (28). The flat surfaces of the swinging bushes (27*a*, 27*b*) (the surfaces on the both sides of the blade (28)) are substantially in surface contact with the blade (46). The circular arc-shaped outer peripheral surface of each of the swinging bushes (27*a*, 27*b*) is substantially in surface contact with the ring-shaped piston (45). The swinging bushes (27*a*, 27*b*) are configured such that the blade (46) is allowed to move forward and backward in the blade groove (28) in its surface direction, with the blade (46) tucked into the blade groove (28). The swinging bushes (27*a*, 27*b*) are configured such that they swing integrally with the blade (46) with respect to the ring-shaped piston (45) at the same time. To sum up, the swinging bush (27) is configured such that the blade (46) and the ring-shaped piston (45) are relatively swingable around the central point of the swinging bush (27) as a swinging center, and, in addition, that the blade (46) is allowed to move forward and backward in the surface direction of the blade (46) with respect to the ring-shaped piston (45).

Note that although in the first embodiment description has been made taking an example in which the bushes (27*a*, 27*b*) are separate bodies it may be arranged such that the bushes (27*a*, 27*b*) are of an integral structure having a joining part therebetween.

The upper housing (36) and the lower housing (37) are provided, respectively, with bearing parts (36*a*, 37*a*) which are sliding bearings. The crank shaft (33) is rotatably supported on the bearing parts (36*a*, 37*a*). In the rotary type compressor (10) of the present first embodiment, the crank shaft (33) passes through the compression mechanism (20) in an up and down direction. The crank shaft (33) is held through the upper and lower housings (36, 37) by the casing (15).

The lower housing (37) is formed in one end part (lower side) of the cylinder (40) and its front surface (upper surface in FIG. 1) faces the cylinder chamber (41, 42). In addition, a muffler (23) is mounted below the lower housing (37). Defined between the lower housing (37) and the muffler (23) is a discharge space (53). In addition, a connection passage (57) for establishing fluid communication between the discharge space (53) and the space above the compression mechanism (20) is defined between the outer edge parts of the upper housing (36) and the lower housing (37).

The electric motor (30) has a stator (31) and a rotor (32). The stator (31) is firmly attached to the internal wall of the body part of the casing (15). The rotor (32) is disposed inside the stator (31) and is coupled to the main shaft part (33*a*) of the crank shaft (33). The rotor (32) is so configured as to rotate along with the crank shaft (33).

An oil supply pump (34) is provided at the lower end part of the crank shaft (33). The oil supply pump (34) is connected to an oil supply path (not illustrated) which extends along the shaft center of the crank shaft (33) to fluidly communicate with the compression mechanism (20). And the oil supply pump (34) is configured such that it feeds lubricant stored on the bottom of the casing (15) to the swinging parts of the compression mechanism (20) via the oil supply path.

In the above-described configuration, when the crank shaft (33) rotates, the outer cylinder (40*a*) and the inner cylinder (40*b*) swing around the central point of the swinging bush (27) as a swing center while moving forward and backward in the direction of the blade groove (28) (the radial direction of the cylinder chamber (41, 42)). By this swing operation, the cylinder (40) moves in a rotation motion (orbital motion) while being off-centered with respect to the crank shaft (33) (see FIGS. 5(A) through 5(D)).

In addition, there is defined outside the outer cylinder (40*a*) a suction space (6) (see FIG. 1). The outlet opening end of the suction pipe (14) passing through the body part of the casing (15) opens to the suction space (6). Additionally, there is formed in the lower housing (37) a suction passage (7) extending in the radial direction of the cylinder (40). The suction passage (7) is made in the form of a long hole shape extending from the inner cylinder chamber (42) to the suction space (6). The suction passage (7) establishes fluid communication between the low pressure chamber (41*b*, 42*b*) of the cylinder chamber (41, 42) and the suction space (6). In addition, the outer cylinder (40*a*) is provided with a through hole (43) for fluid communication between the suction space (6) and the low pressure chamber (41*b*) of the outer cylinder chamber (41). The ring-shaped piston (45) is provided with a through hole (44) for fluid communication between the low pressure chamber (41*b*) of the outer cylinder chamber (41) and the low pressure chamber (42*b*) of the inner cylinder chamber (42).

Figure 3:
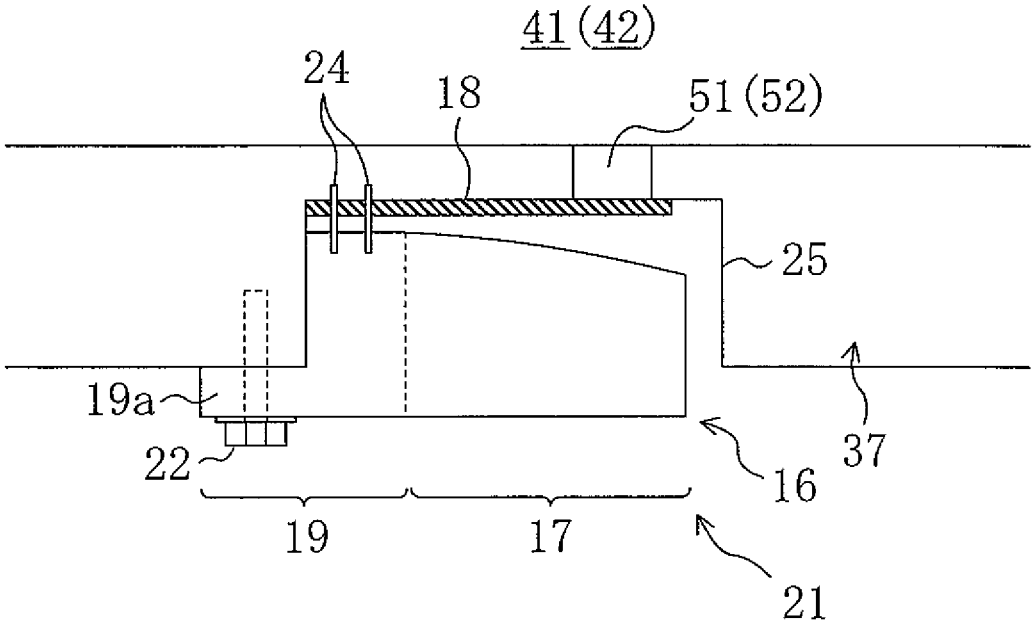
FIG. 3 is a cross sectional view of a discharge valve of the rotary type compressor of the first embodiment.
Figure 4:
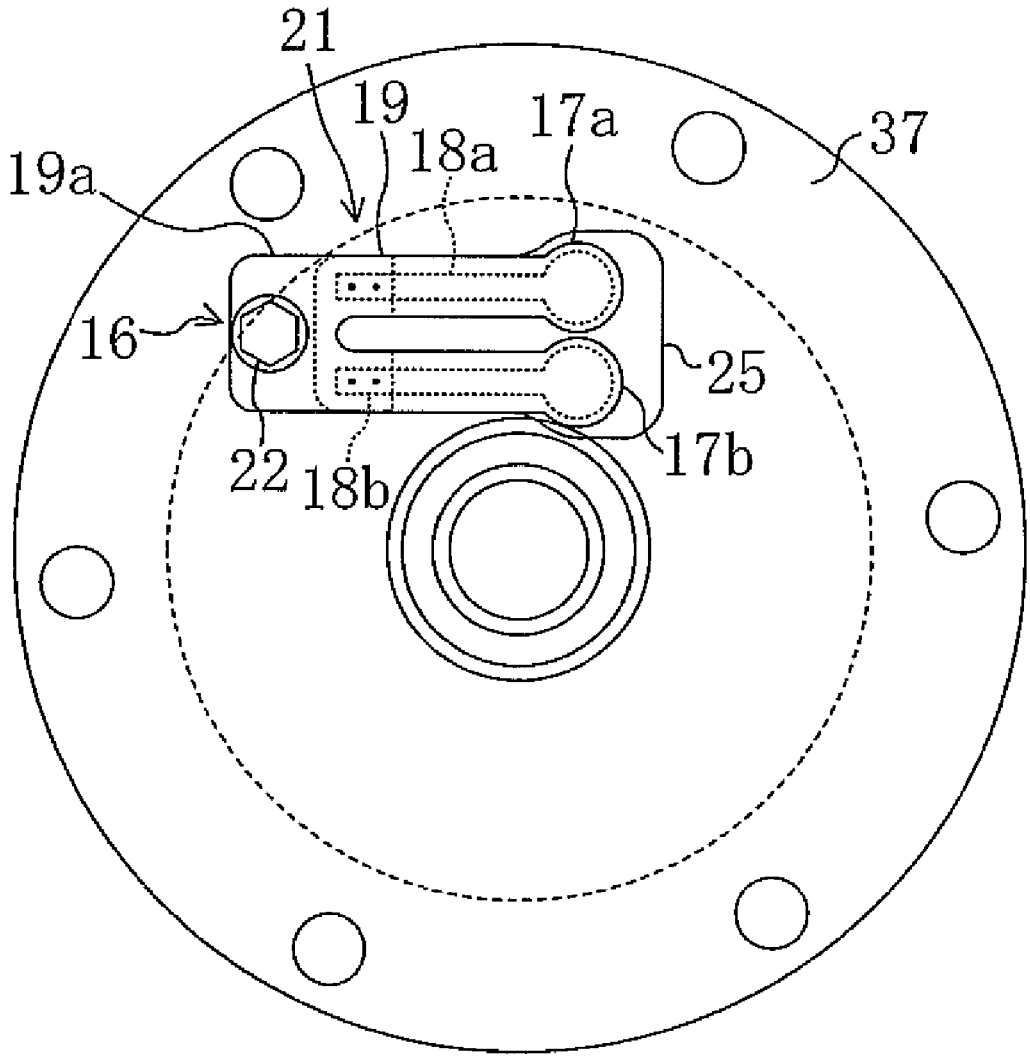
FIG. 4 is a top plan view of a lower housing of the rotary type compressor of the first embodiment.

As shown in FIG. 3, the lower housing (37) is provided, in its back surface (surface on the side of the discharge space (53)), with a receding part (25). The thickness of the bottom surface portion of the receding part (25) of the lower housing (37) is thin as compared to its surrounding area. As shown in FIG. 4, the receding part (25) is a dent of approximately rectangular shape and is located in the vicinity of the middle between the center and the outer periphery of the lower housing (37).

The lower housing (37) is provided with an outer discharge passage (51) and an inner discharge passage (52) which are in fluid communication with the cylinder chambers (41, 42) and which open at the bottom surface of the receding part (25). The outer discharge passage (51) and the inner discharge passage (52) are arranged side by side in the shorter direction of the receding part (25) on the side of one longer-directional end of the receding part (25). The inlet opening end of the outer discharge passage (51) opens to the high pressure chamber (41*a*) of the outer cylinder chamber (41) while on the other hand the inlet opening end of the inner discharge passage (52) opens to the high pressure chamber (42*a*) of the inner cylinder chamber (42). These discharge passages (51, 52) connect the high pressure chambers (41*a*, 42*a*) of the cylinder chambers (41, 42) to the discharge space (53).

A first valve disc (18*a*) and a second valve disc (18*b*) are set in the receding part (25). Both the first valve disc (18*a*) and the second valve disc (18*b*) are of long and thin plate shape and their leading ends are of circular shape slightly larger than the outlet opening of each of the discharge passages (51, 52). The longer direction of each of the first and second valve discs (18*a*, 18*b*) agrees with that of the receding part (25) and these valve discs are arranged such that their front surfaces are in abutment with the bottom surface of the receding part (25). The first valve disc (18*a*) is arranged such that the front surface of its leading end part is in abutment with the surrounding area of the outlet opening of the outer discharge passage (51) which is a valve seat surface. On the other hand, the second valve disc (18*b*) is arranged such that the front surface of its leading end part is in abutment with the surrounding area of the outlet opening of the inner discharge passage (52) which is a valve seat surface.

The lower housing (37) is provided with a valve guard (16). The valve guard (16) is made up of a base part (19), a first main body part (17*a*), and a second main body part (17*b*). The valve guard (16) is formed such that the two main body parts (17*a*, 17*b*) extend, in the same direction and in a separate state from each other, from the side surface of the base part (19), and that it is of squared U-shape when viewed from top. The main body part (17) is formed such that its upper surface bends in a curve to become thinner towards the leading end and is provided on the back surface side of the valve disc (18). The upper surface of the main body part (17) serves as a valve guard surface. The valve guard (16) and the valve disc (18) together constitute a discharge valve (21) of the present invention. The discharge valve (21) is a reed valve and is configured such that it opens and closes the discharge passage (51, 52) by elastic deformation of the valve disc (18).

The base part (19) of the valve guard (16) is formed such that it is thick on the side of the main body part (17), but thin on the opposite side. A single through hole for insertion of a bolt (22) therethrough is formed in the thin portion of the base part (19). The thin portion of the base part (19) is a fixation part (19*a*) for attachment of the valve guard (16) to the lower housing (37). The lower surface of the base part (19) is flatly formed and is flush with the lower surface of the main body part (17). The upper surface of the base part (19) is continuous to the upper surface of the main body part (17), but there is formed in the boundary between the thick portion and the thin fixation part (19*a*) a step (difference in level).

The valve guard (16) is mounted to the lower housing (37), with the fixation part (19*a*) thereof firmly attached to the outer peripheral part of the receding part (25) by the bolt (22). In the valve guard (16), the stepped surface of the base part (19) is in abutment with the wall surface on the side (left-hand side in FIG. 4) opposite to the side where the discharge passages (51, 52) of the receding part (25) are provided, and the upper surface of the fixation part (19*a*) is in abutment with the back surface (lower surface) of the lower housing (37). The fixation part (19*a*) extends, along the back surface of the lower housing (37), to outside of the receding part (25).

There is defined between the bottom surface of the receding part (25) and the valve guard (16) a clearance gap in excess of the thickness of the valve disc (18). That is, in the state in which the valve disc (18) is in close contact with the bottom surface of the receding part (25), there is defined between the valve disc (18) and the valve guard (16) a clearance gap. This clearance gap becomes greater as it is poisoned closer to the leading end side of the valve disc (18).

In addition, the discharge valve (21) is provided with pin members (24, 24) passing respectively through the base end part of the first valve disc (18*a*) and through the base end part of the second valve disc (18*b*). More specifically, two pin members (24) are provided for each of the valve discs (18*a*, 18*b*). One end part of each pin member (24) is engaged into the thick portion of the base part (19) of the valve guard (16) while the other end part is engaged into the bottom surface of the receding part (25). Consequently, the first valve disc (18*a*) and the second valve disc (18*b*) become movable in the axial direction of the pin members (24) while on the other hand their rotation is prevented.

Running Operation

Next, referring to FIGS. 5A to 5D, the running operation of the rotary type compressor (10) is described below.

When the electric motor (30) is activated, rotation of the rotor (32) is transmitted through the crank shaft (33) to the outer and inner cylinders (40*a*, 40*b*) of the compression mechanism (20). As a result, the blade (46) moves in a reciprocating motion (forward/backward motion) between the swinging bushes (27*a*, 27*b*) and, in addition, the blade (46) and the bushes (27*a*, 27*b*) perform, in an integrated manner a swinging motion on the ring-shaped piston (45). And, the outer cylinder (40*a*) and the inner cylinder (40*b*) orbitally rotate while swinging with respect to the ring-shaped piston (45), and the compression mechanism (20) performs a given compression operation.

Figure 5A:
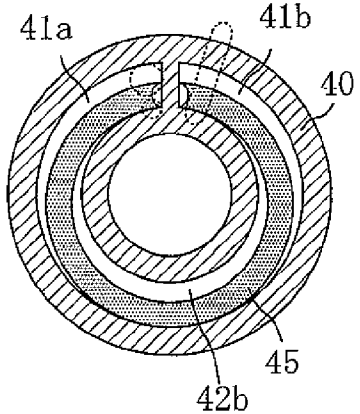
FIG. 5 shows transverse cross sectional views illustrating how the compression mechanism of the rotary type compressor of the first embodiment operates.
Figure 5B:
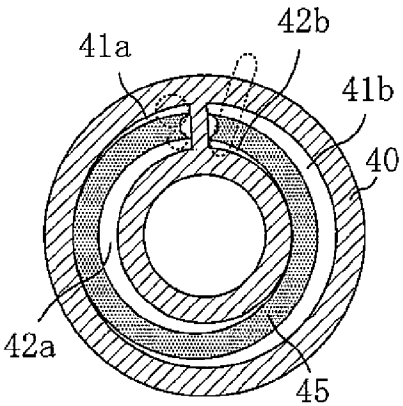
Figure 5C:
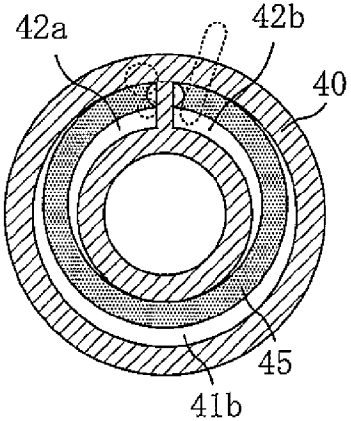
Figure 5D:
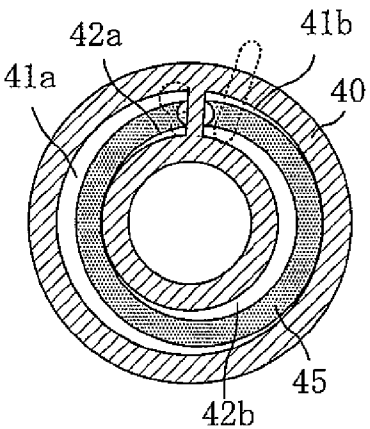

Here, in the outer cylinder chamber (41), the cylinder (40) orbitally rotates in a clockwise direction from the state of FIG. 5(D) (the state in which the volume of the low pressure chamber (41*b*) is approximately minimized), whereby refrigerant (carbon dioxide) is drawn into the low pressure chamber (41*b*) from the suction passage (7). Simultaneously, refrigerant is drawn through the through hole (43) into the low pressure chamber (41*b*) from the suction space (6). And the cylinder (40) orbitally rotates in the order of (A), (B), and (C) of FIG. 5 to reenter the state (D) of FIG. 5. Then, suction of the refrigerant into the low pressure chamber (41*b*) is completed.

Here, this low pressure chamber (41*b*) becomes a high pressure chamber (41*a*) in which refrigerant is compressed, while there is defined across the blade (46) a new low pressure chamber (41*b*). If, in this state, the cylinder (40) further rotates, suction of the refrigerant is repeated in the newly-defined low pressure chamber (41*b*) while the volume of the high pressure chamber (41*a*) decreases whereby refrigerant is compressed in the high pressure chamber (41*a*). And when the pressure in the high pressure chamber (41*a*) exceeds a back pressure acting on the first valve disc (18*a*), the first valve disc (18*a*) deforms towards the valve guard (16) and shifts towards the valve guard (16), and its leading end part moves away from the surrounding area of the outlet opening of the outer discharge passage (51) which is a valve seat. Consequently, the high pressure refrigerant compressed in the outer cylinder chamber (41) passes through the outer discharge passage (51) and is discharged to the discharge space (53).

In the inner cylinder chamber (42), the cylinder (40) orbitally rotates in a clockwise direction in the figure from the state of FIG. 5(B) (the state in which the volume of the low pressure chamber (42*b*) is approximately minimized), whereby refrigerant is drawn into the low pressure chamber (42*b*) from the suction passage (7). Simultaneously, refrigerant is drawn through the through hole (44) into the low pressure chamber (42*b*) from the suction space (6). And the cylinder (40) orbitally rotates in the order of (C), (D), and (A) of FIG. 5 to reenter the state (B) of FIG. 5. Then, suction of the refrigerant into the low pressure chamber (42*b*) is completed.

Here, this low pressure chamber (42*b*) becomes a high pressure chamber (42*a*) in which refrigerant is compressed, while there is defined across the blade (46) a new low pressure chamber (42*b*). If, in this state, the cylinder (40) farther rotates, suction of the refrigerant is repeated in the newly-defined low pressure chamber (42*b*) while the volume of the high pressure chamber (42*a*) decreases whereby refrigerant is compressed in the high pressure chamber (42*a*). And when the pressure in the high pressure chamber (42*a*) exceeds a back pressure acting on the second valve disc (18*b*), the second valve disc (18*b*) deforms towards the valve guard (16) and shifts towards the valve guard (16), and its leading end part moves away from the surrounding area of the outlet opening of the inner discharge passage (52) which is a valve seat. Consequently, the high pressure refrigerant compressed in the inner cylinder chamber (42) passes through the inner discharge passage (52) and is discharged to the discharge space (53).

The refrigerant discharged to the discharge space (53) flows and passes through the connection passage (57), flows into a space above the compression mechanism (20), flows and passes through a clearance gap defined around the electric motor (30), and is discharged from the discharge pipe (13).

Note that the amount of shift and the amount of deformation of the valve disc (18) are restricted by the valve guard (16). In addition, when the pressure in the high pressure chamber (41*a*, 42*a*) enters the low pressure state, the leading end part of the valve disc (18) is drawn towards the bottom surface of the receding part (25) by the difference in pressure between the discharge space (53) and the high pressure chamber (41*a*, 42*a*). Consequently, the leading end part of the valve disc (18) is again brought into close contact with the valve seat surface of the discharge passage (51, 52), whereby the outlet opening of the discharge passage (51, 52) is closed.

Advantageous Effects of the First Embodiment

In the first embodiment, the fixation part (19*a*) of the valve guard (16) is set such that it extends to outside of the receding part (25). And the fixation part (19*a*) is firmly attached to the outside of the receding part (25) of the lower housing (37) whereby the valve guard (16) is mounted to the lower housing (37). This therefore eliminates the need for securing space for firm attachment of the valve guard (16) in the receding part (25), thereby making it possible to reduce the size of area of the receding part (25) of weaker strength as compared to the surrounding area. Accordingly, the deformation of the lower housing (37) taking place in the process of refrigerant compression in the cylinder chamber (41, 42) can be reduced, thereby making it possible to reduce leakage of refrigerant from the cylinder chamber (41, 42) associated with the deformation of the lower housing (37). Therefore, the efficiency of compression is improved in the rotary type compressor (10) of the first embodiment.

In addition, in the first embodiment, the two pin members (24, 24) are passed through the base end part of the valve disc (18). The both ends of each of the two pin members (24, 24) are engaged, respectively, into the valve guard (16) and the bottom surface of the receding part (25). Consequently, the movement of the valve disc (18) is restricted and the valve disc (18) is prevented from rotation.

In addition, in the first embodiment, because of formation of the clearance gap between the valve guard (16) and the bottom surface of the receding part (25), the valve disc (18) is made able to move in the axial direction of the pin members (24). That is, the outlet opening of the discharge passage (51, 52) is opened by movement of the valve disc (18) in the axial direction of the pin members (24). Accordingly, the amount of deformation of the valve disc (18) when the refrigerant is discharged from the discharge passage (51, 52) is restrained low, thereby making it possible to reduce the loss of discharge pressure at that time. Now, therefore, the loss of overcompression when the refrigerant is discharged from the discharge passage (51, 52) can be reduced whereby the efficiency of compression is further improved in the rotary type compressor (10) of the first embodiment.

In addition, in the first embodiment, the rotary type compressor (10) is installed in the refrigerant circuit which uses carbon dioxide as a refrigerant. Consequently, when the cylinder chamber (41, 42) is in the low pressure state in the process of refrigerant compression, the difference in pressure occurring between the cylinder chamber (41, 42) and the discharge space side becomes greater as compared to the case of use of a common Freon refrigerant. The size of area occupied by the receding part (25) in the lower housing (37) is conventionally great, so that if the rotary type compressor (10) is installed in a refrigerant circuit using carbon dioxide as a refrigerant, the amount of deformation of the lower housing (37) tends to increase due to the aforesaid pressure difference across the lower housing (37). On the other hand, in accordance with the rotary type compressor (10) of the present first embodiment, the size of area of the receding part (25) becomes reduced, thereby enhancing the rigidity of the lower housing (37). Accordingly, the rotary type compressor (10) of the present first embodiment is especially useful when provided in a refrigerant circuit using carbon dioxide as a refrigerant.

In addition, in the first embodiment, the main body part (17) of the valve guard (16) is relatively thick, as a result of which the length of a refrigerant flowpath between the side surface of the main body part (17) and the wall surface of the receding part (25) and the length of a refrigerant flowpath between the side surface of the first main body part (17*a*) and the side surface of the second main body part (17*b*) become increased. In the case where carbon dioxide is used as a refrigerant, the refrigeration capacity per flow rate of the refrigerant is high as compared to the case where a common Freon refrigerant is employed. Consequently, the velocity of flow of the refrigerant discharged from the cylinder chamber (41, 42) is low when compared at the same refrigeration capacity. Accordingly, in the case where carbon dioxide is used as refrigerant, the loss of pressure of the refrigerant passing through such a refrigerant flowpath becomes reduced.

Second Embodiment of the Invention

Figure 6:
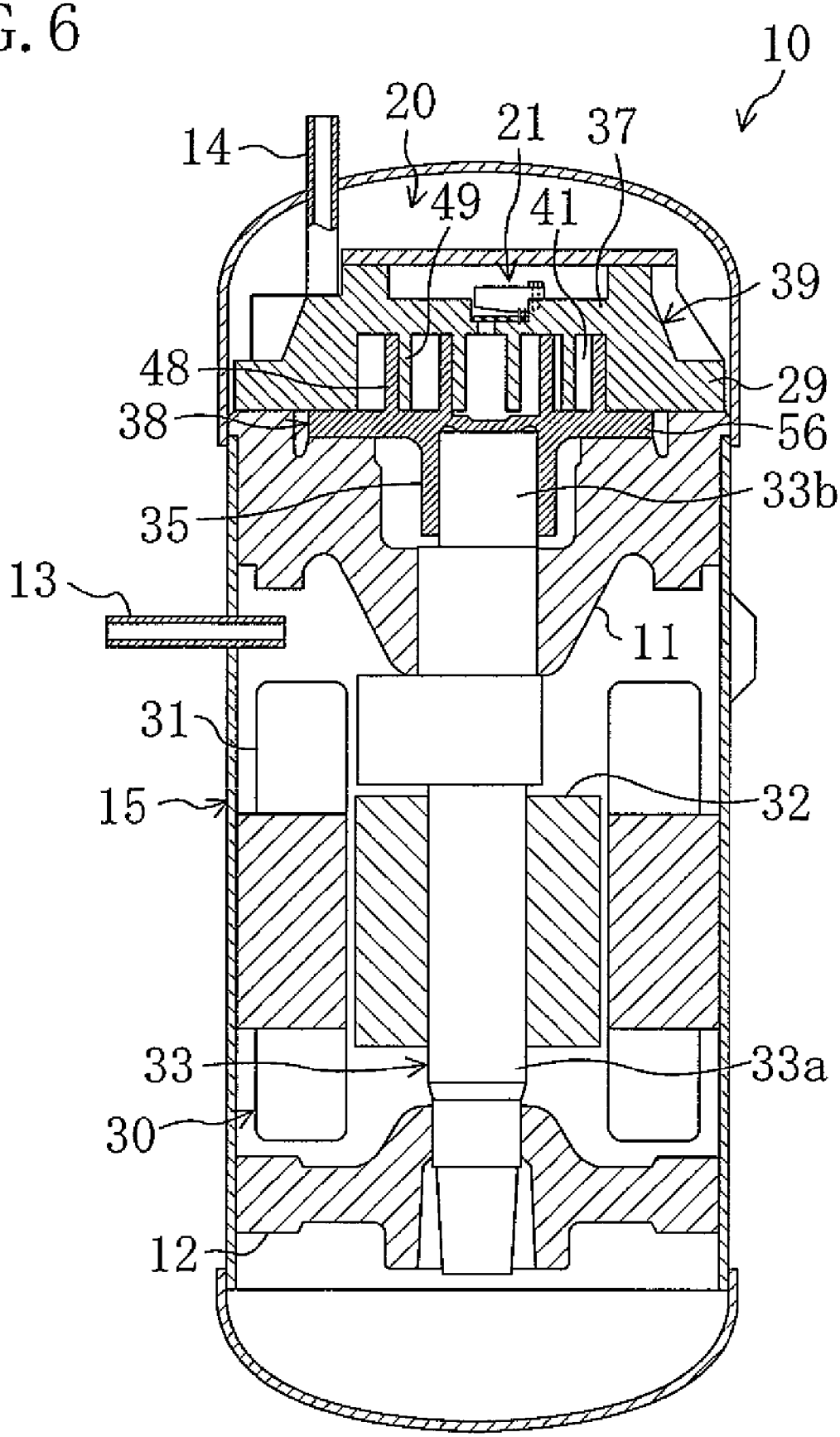
FIG. 6 is a longitudinal cross sectional view of a rotary type compressor according to a second embodiment of the present invention.

A second embodiment of the present invention is now described. Referring to FIG. 6, there is shown a longitudinal cross sectional view of a compressor (10) of the second embodiment. This compressor (10) is a rotary type compressor (10) of the scroll type which is configured to compress refrigerant in a compression chamber (41) by orbital motion of a movable scroll (38) (to be hereinafter described) against a fixed scroll (39). As in the first embodiment, the compressor (10) of the second embodiment is installed in a refrigerant circuit of a refrigeration apparatus which is charged with carbon dioxide as a refrigerant and which performs a vapor compression refrigeration cycle.

The compressor (10) has a casing (15) which is a longitudinally long, cylinder-shaped, hermetical container. The casing (15) contains thereinside a compression mechanism (20) and an electric motor (30) wherein the compression mechanism (20) is positioned nearer the upper side while the electric motor (30) is positioned nearer the lower side.

The casing (15) is provided with a suction pipe (14) which runs through its upper part. The suction pipe (14) is connected to the compression mechanism (20). In addition, the casing (15) is further provided with a discharge pipe (13) which runs through its body part. The discharge pipe (13) has an inlet opening which opens to a space defined between the compression mechanism (20) and the electric motor (30).

The casing (15) contains thereinside a crank shaft (33) extending in an up and down direction. This crank shaft (33) has a main shaft part (33*a*) and an eccentric part (33*b*). The main shaft part (33*a*) is formed such that its upper end part has a rather great diameter. The eccentric part (33*b*) is formed into a circular cylinder shape having a smaller diameter than that of the main shaft part (33*a*), and is standingly mounted on the upper end surface of the main shaft part (33*a*). The axial center of the eccentric part (33*b*) is off-centered from that of the main shaft part (33*a*) by a given amount.

A lower bearing member (12) which is firmly attached to the lower end part of the body part of the casing (15) is provided below the electric motor (30). A sliding bearing is formed in the middle of the lower bearing member (12). This sliding bearing rotatably supports the lower end part of the main shaft part (33*a*).

The electric motor (30) has a stator (31) and a rotor (32). The stator (31) is firmly attached to the internal wall of the body part of the casing (15). The rotor (32) is disposed inside the stator (31) and is coupled to the main shaft part (33*a*) of the crank shaft (33). The rotor (32) is so configured as to rotate along with the crank shaft (33).

The compression mechanism (20) has a movable scroll (38) which is a movable member which moves in an eccentric motion, a fixed scroll (39) which is a fixed member which cooperates with the movable scroll (38) to form a compression chamber (41, 42) to be hereinafter described, and a housing (11). The housing (11) is shaped like a relatively thick, circular plate with a dent in the middle thereof. The outer peripheral part of the housing (11) is joined to the upper end part of the body part of the casing (15). In addition, the main shaft part (33*a*) of the crank shaft (33) is inserted through the middle of the housing (11). The housing (11) constitutes a bearing for rotatably supporting the main shaft part (33*a*) of the crank shaft (33).

The movable scroll (38) has an end plate part (56) of circular plate shape, a movable side wrap (48) of spiral wall shape which is standingly mounted on the front surface side (upper surface side in FIG. 6) of the end plate part (56), and a projecting part (35) of cylindrical shape which projects towards the back surface side (lower surface side in FIG. 6) of the end plate part (56). The movable scroll (38) is placed through an Oldham ring (not illustrated) on the upper surface of the housing (11). In addition, the eccentric part (33*b*) of the crank shaft (33) is inserted into the projecting part (35) of the movable scroll (38), in other words the movable scroll (38) is engaged to the crank shaft (33).

The fixed scroll (39) has an end plate part (37) of circular plate shape, a fixed side wrap (49) of spiral wall shape which is standingly mounted on the front surface side (lower surface side in FIG. 6) of the end plate part (37), and a relatively thick outer peripheral part (29) which is continuously formed outwardly from the outer periphery of the end plate part (37).

Figure 7:
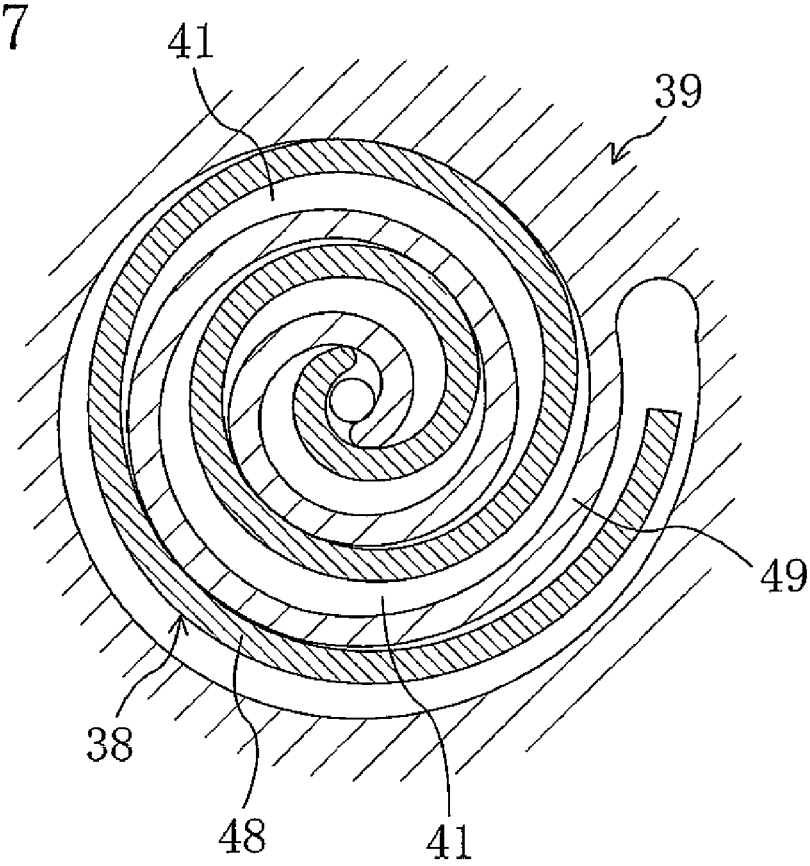
FIG. 7 is a transverse cross sectional view of a compression mechanism of the rotary type compressor of the second embodiment.

As shown in FIG. 7, in the compression mechanism (20), the fixed side wrap (49) of the fixed scroll (39) and the movable side wrap (48) of the movable scroll (38) are engaged with each other. And, by mutual engagement between the fixed side wrap (49) and the movable side wrap (48), there are formed a plurality of compression chambers (41).

Figure 8:
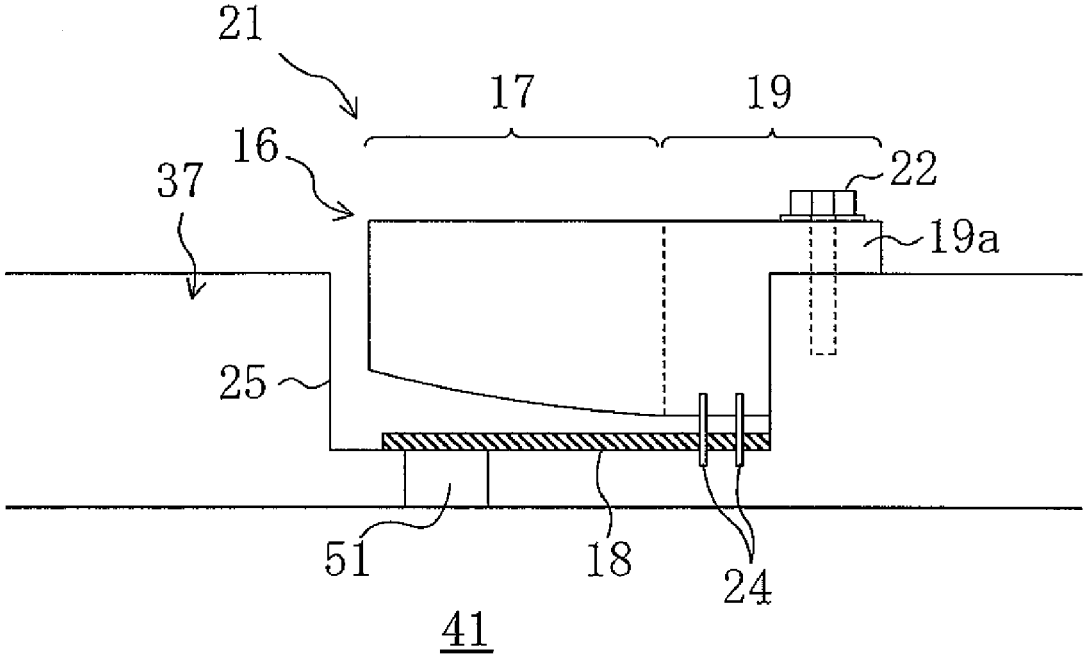
FIG. 8 is a cross sectional view of a discharge valve of the rotary type compressor of the second embodiment.

Referring to FIG. 8, the end plate part (37) of the fixed scroll (39) is provided, in its back surface (upper surface in FIG. 8), with a receding part (25). The thickness of the bottom surface portion of the receding part (25) of the end plate part (37) is thin as compared to its surrounding area. The receding part (25) is a dent of approximately rectangular shape and is situated in the vicinity of the middle of the end plate part (37).

The end plate part (37) is provided with a discharge passage (51) which is in fluid communication with the compression chamber (41) and which opens at the bottom surface of the receding part (25). The discharge passage (51) is provided on the side of one longer-directional end of the receding part (25) (left-hand side in FIG. 8). The discharge passage (51) establishes connection between the compression chamber (41) and the space above the compression mechanism (20).

The receding part (25) contains thereinside a valve disc (18). The valve disc (18) is of long and thin plate shape and its leading end is in the form of a circular shape slightly larger than the outlet opening of the discharge passage (51). The longer direction of the valve disc (18) agrees with that of the receding part (25) and the valve disc (18) is arranged such that its front surface is in abutment with the bottom surface of the receding part (25). The valve disc (18) is arranged such that the front surface of its leading end part is in abutment with the surrounding area of the outlet opening of the discharge passage (51) which is a valve seat surface.

The end plate part (37) is provided with a valve guard (16). The valve guard (16) is made up of a base part (19) and a main body part (17). The main body part (17) is formed such that its lower surface bends in a curve to thereby make the thickness of the main body part (17) thinner towards the leading end. The main body part (17) is provided on the back surface side of the valve disc (18) and its lower surface serves as a valve guard surface. The valve guard (16) and the valve disc (18) together constitute a discharge valve (21) of the present invention. The discharge valve (21) is a reed valve and is configured such that it opens and closes the discharge passage (51) by elastic deformation of the valve disc (18).

The base part (19) of the valve guard (16) is formed such that it is thick on the side of the main body part (17), but thin on the opposite side. A single through hole for insertion of a bolt (22) therethrough is formed in the thin portion of the base part (19). The thin portion of the base part (19) is a fixation part (19*a*) for attachment of the valve guard (16) to the end plate part (37). The upper surface of the base part (19) is flatly formed and is flush with the upper surface of the main body part (17). The lower surface of the base part (19) is continuous to the lower surface of the main body part (17), but there is formed in the boundary between the thick portion and the thin fixation part (19*a*) a step.

The valve guard (16) is mounted to the end plate part (37), with the fixation part (19*a*) thereof firmly attached to the outer peripheral part of the receding part (25) by the bolt (22). In the valve guard (16), the stepped surface of the base part (19) is in abutment with the wall surface on the side (right-hand side in FIG. 8) opposite to the side where the discharge passage (51) of the receding part (25) is provided, and the lower surface of the fixation part (19*a*) is in abutment with the back surface (upper surface) of the end plate part (37). The fixation part (19*a*) extends, along the back surface of the end plate part (37), to outside of the receding part (25).

There is defined between the bottom surface of the receding part (25) and the valve guard (16) a clearance gap in excess of the thickness of the valve disc (18). That is, in the state in which the valve disc (18) is in close contact with the bottom surface of the receding part (25), there is defined between the valve disc (18) and the valve guard (16) a clearance gap. This clearance gap becomes greater as it is poisoned closer to the leading end side of the valve disc (18).

In addition, the discharge valve (21) is provided with two pin members (24, 24) passing through the base end part of the valve disc (18). One end part of each pin member (24) is engaged into the thick portion of the base part (19) of the valve guard (16) while the other end part is engaged into the bottom surface of the receding part (25). Consequently, the valve disc (18) becomes movable in the axial direction of the pin members (24) while on the other hand its rotation is prevented.

Running Operation

Next, the running operation of the rotary type compressor (10) of the scroll type is described below.

When the electric motor (30) is activated, rotation of the rotor (32) is transmitted through the crank shaft (33) to the movable scroll (38) of the compression mechanism (20). The movable scroll (38) which engages with the eccentric part (33*b*) of the crank shaft (33) is guided by the Oldham ring and moves only in an orbital motion without rotation.

When the movable scroll (38) orbitally rotates, low pressure gas refrigerant passes through the suction pipe (14) and then flows into the compression chamber (41) from the outer peripheral side of each of the movable side wrap (48) and the fixed side wrap (49). If the movable scroll (38) orbitally rotates to a further extent, gas refrigerant confined within the compression chamber (41) gradually travels to the inside of the compression mechanism (20), with the consequence that the volume of the compression chamber (41) decreases to cause the gas refrigerant to be compressed. And the compressed gas refrigerant is guided to the inside of the compression mechanism (20) where the inlet opening end of the discharge passage (51) opens, and, if the pressure of the gas refrigerant exceeds a back pressure acting on the valve disc (18), the valve disc (18) deforms towards the valve guard (16) and moves towards the valve guard (16). And the valve disc (18) moves away from the surrounding area of the outlet opening of the discharge passage (51) which is a valve seat surface, and gas refrigerant compressed to high pressure is discharged to a space above the compression mechanism (20) by way of the discharge passage (51). The gas refrigerant discharged from the compression mechanism (20) flows into a space below the compression mechanism (20) by way of a passage (not illustrated) and then is discharged to outside of the casing (15) from the discharge pipe (13).

Third Embodiment of the Invention

Figure 9:
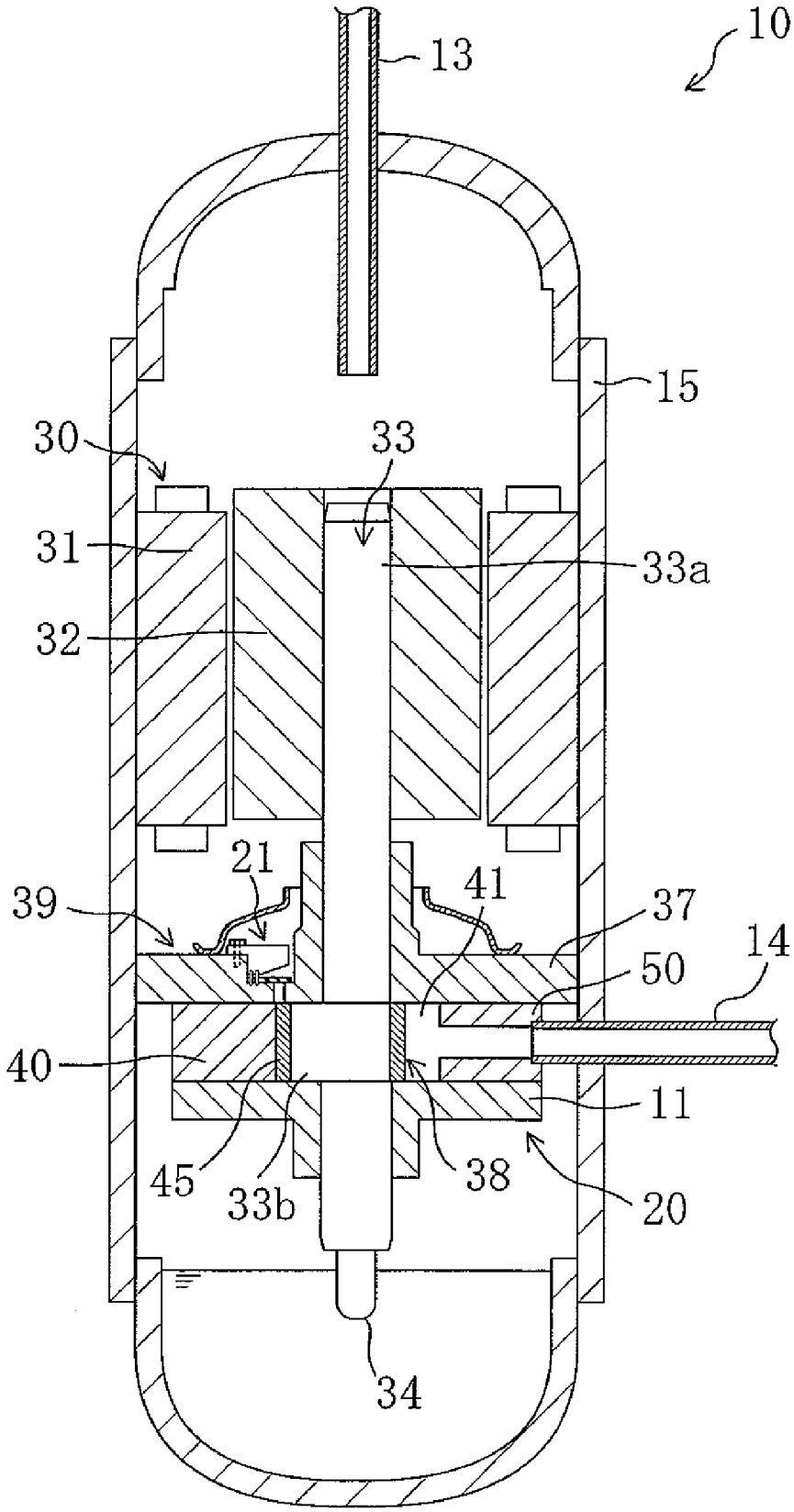
FIG. 9 is a longitudinal cross sectional view of a rotary type compressor according to a third embodiment of the present invention.

A third embodiment of the present invention is now described below. Referring to FIG. 9, there is shown a longitudinal cross section of a compressor (10) of the third embodiment. The compressor (10) is a rotary type compressor (10) of the swinging type in which refrigerant in a compression chamber (41) is compressed by swinging motion of a piston (45) (hereinafter described) within a cylinder (40). The compressor (10) is installed in a refrigerant circuit of a refrigeration apparatus which is charged with carbon dioxide as a refrigerant and which performs a vapor compression refrigeration cycle, as in the first embodiment.

The compressor (10) has a casing (15) which is a longitudinally long, cylinder-shaped, hermetical container. The casing (15) contains thereinside a compression mechanism (20) and an electric motor (30) wherein the compression mechanism (20) is positioned nearer the lower side while the electric motor (30) is positioned nearer the upper side.

The casing (15) is provided with a suction pipe (14) so that the suction pipe (14) runs through the body side of the casing (15). The suction pipe (14) is connected to the compression mechanism (20). In addition, the casing (15) is provided with a discharge pipe (13) which runs through its top side. The discharge pipe (13) has an inlet opening which opens to a space above the electric motor (30).

The casing (15) contains thereinside a crank shaft (33) which extends in an up and down direction. The crank shaft (33) has a main shaft part (33*a*) and an eccentric part (33*b*). The eccentric part (33*b*) is positioned nearer the lower end of the crank shaft (33) and is shaped like a circular cylinder of greater diameter than that of the main shaft part (33*a*). The axial center of the eccentric part (33) is off-centered by a given amount from that of the main shaft part (33*a*).

The compression mechanism (20) constitutes a rotary type compressor of the swinging piston type, and has a movable member (38) which moves in an eccentric motion and a fixed member (39) which cooperates with the movable member (38) to form a compression chamber (41) to be hereinafter described. The movable member (38) has a ring-shaped piston (45). The fixed member (39) has a cylinder (40), an end plate part (37) of circular plate shape which comes into abutment with the upper surface side of the cylinder (40), and a housing (11) of circular plate shape which comes into abutment with the lower surface side of the cylinder (40).

Figure 10:
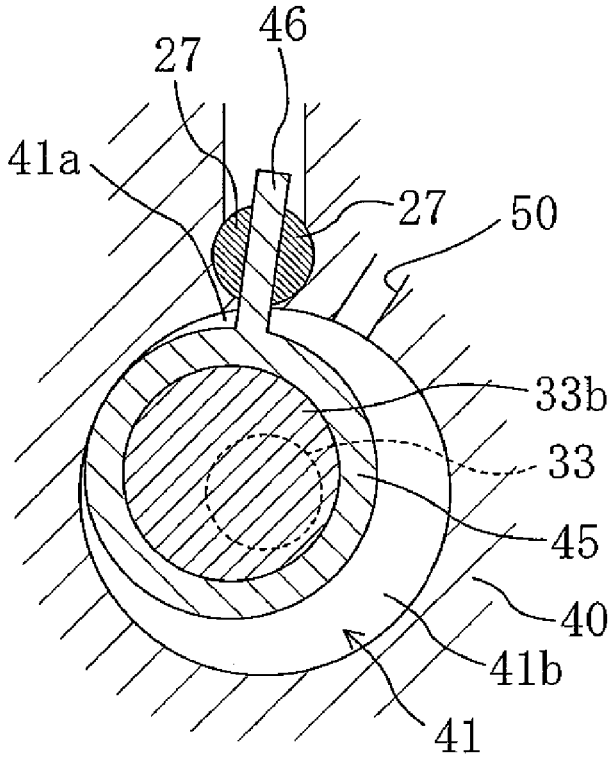
FIG. 10 is a transverse cross sectional view of a compression mechanism of the rotary type compressor of the third embodiment.

As shown in FIG. 10, the piston (45) is formed in a circular ring shape and is disposed within the cylinder (40). The eccentric part (33*b*) of the crank shaft (33) is slidably engaged into the inner peripheral surface of the piston (45). The compression chamber (41) is defined between the outer peripheral surface of the piston (45) and the inner peripheral surface of the cylinder (40). In addition, a blade (46) of flat plate shape is projectingly provided on the side surface of the piston (45). This blade (46) is supported through a swinging bush (27) by the cylinder (40). In this way, the blade (46) divides the compression chamber (41) into a high pressure chamber (41*a*) which is a first chamber and a low pressure chamber (41*b*) which is a second chamber.

The cylinder (40) is provided with a suction port (50). The suction port (50) extends through the cylinder (40) in the radial direction thereof and its terminal end opens at the inner peripheral surface of the cylinder (40). A suction pipe (14) is inserted into the suction port (50).

The electric motor (30) has a stator (31) and a rotor (32). The stator (31) is firmly attached to the internal wall of the body part of the casing (15). The rotor (32) is disposed inside the stator (31) and is coupled to the main shaft part (33*a*) of the crank shaft (33). The rotor (32) is so configured as to rotate along with the crank shaft (33).

An oil supply pump (34) is provided at the lower end part of the crank shaft (33). The oil supply pump (34) is connected to an oil supply path (not illustrated) which extends along the shaft center of the crank shaft (33) to fluidly communicate with the compression mechanism (20). And the oil supply pump (34) is configured such that it feeds lubricant stored on the bottom of the casing (15) to the swinging parts of the compression mechanism (20) via the oil supply path.

Figure 11:
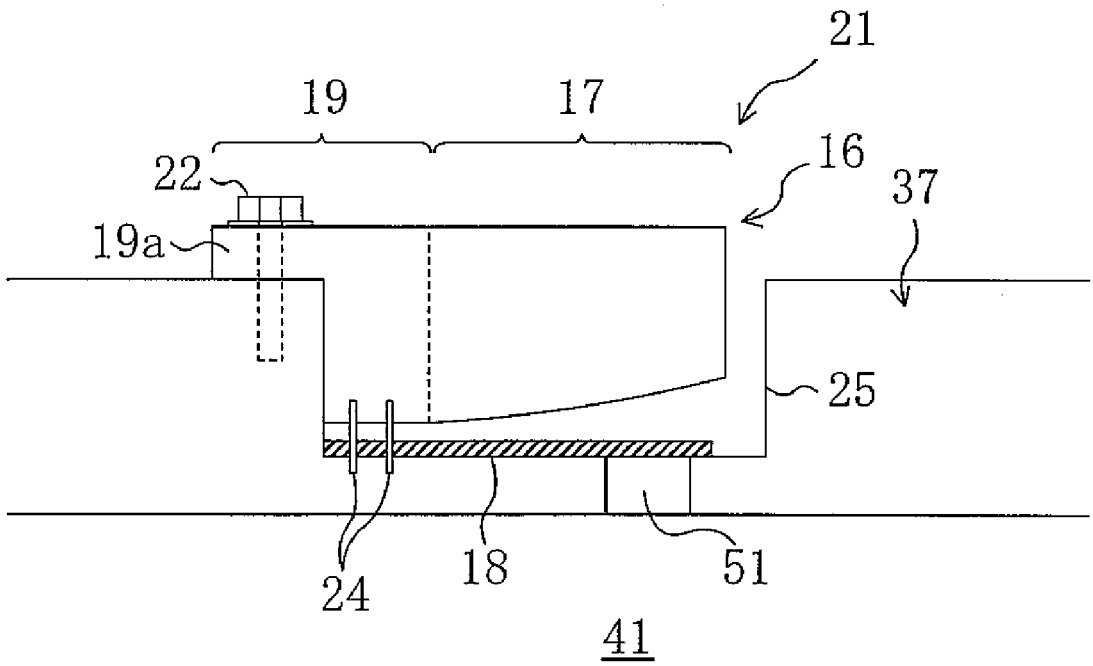
FIG. 11 is a cross sectional view of a discharge valve of the rotary type compressor of the third embodiment.

The front surface (lower surface in FIG. 9) of the end plate part (37) faces the compression chamber (41). Referring to FIG. 11, the end plate part (37) is provided, in its back surface (upper surface in FIG. 11), with a receding part (25). The thickness of the bottom surface portion of the receding part (25) of the end plate part (37) is thin as compared to its surrounding area. The receding part (25) is a dent of approximately rectangular shape and is formed in the vicinity of the middle between the center and the outer periphery of the end plate part (37).

The end plate part (37) is provided with a discharge passage (51) which is in fluid communication with the compression chamber (41) and which opens at the bottom surface of the receding part (25). The discharge passage (51) is provided on the side of one longer-directional end of the receding part (25) (right-hand side in FIG. 11). The discharge passage (51) establishes connection between the compression chamber (41) and the space above the compression mechanism (20).

The receding part (25) contains thereinside a valve disc (18). The valve disc (18) is of long and thin plate shape and its leading end is in the form of a circular shape slightly larger than the outlet opening of the discharge passage (51). The longer direction of the valve disc (18) agrees with that of the receding part (25) and the valve disc (18) is arranged such that its front surface is in abutment with the bottom surface of the receding part (25). The valve disc (18) is arranged such that the front surface of its leading end part is in abutment with the surrounding area of the outlet opening of the discharge passage (51) which is a valve seat surface.

The end plate part (37) is provided with a valve guard (16). The valve guard (16) is made up of a base part (19) and a main body part (17). The main body part (17) is formed such that its lower surface bends in a curve to thereby make the thickness of the main body part (17) thinner towards the leading end. The main body part (17) is provided on the back surface side of the valve disc (18) and its lower surface serves as a valve guard surface. The valve guard (16) and the valve disc (18) together constitute a discharge valve (21) of the present invention. The discharge valve (21) is a reed valve and is configured such that it opens and closes the discharge passage (51) by elastic deformation of the valve disc (18).

The base part (19) of the valve guard (16) is formed such that it is thick on the side of the main body part (17), but thin on the opposite side. A single through hole for insertion of a bolt (22) therethrough is formed in the thin portion of the base part (19). The thin portion of the base part (19) is a fixation part (19*a*) for attachment of the valve guard (16) to the end plate part (37). The upper surface of the base part (19) is flatly formed and is flush with the upper surface of the main body part (17). The lower surface of the base part (19) is continuous to the lower surface of the main body part (17), but there is formed in the boundary between the thick portion and the thin fixation part (19*a*) a step.

The valve guard (16) is mounted to the end plate part (37), with the fixation part (19*a*) thereof firmly attached to the outer peripheral part of the receding part (25) by the bolt (22). In the valve guard (16), the stepped surface of the base part (19) is in abutment with the wall surface on the side (left-hand side in FIG. 11) opposite to the side where the discharge passage (51) of the receding part (25) is provided, and the lower surface of the fixation part (19*a*) is in abutment with the back surface (upper surface) of the end plate part (37). The fixation part (19*a*) extends, along the back surface of the end plate part (37), to outside of the receding part (25).

There is defined between the bottom surface of the receding part (25) and the valve guard (16) a clearance gap in excess of the thickness of the valve disc (18). That is, in the state in which the valve disc (18) is in close contact with the bottom surface of the receding part (25), there is defined between the valve disc (18) and the valve guard (16) a clearance gap. This clearance gap becomes greater as it is poisoned closer to the leading end side of the valve disc (18).

In addition, the discharge valve (21) is provided with two pin members (24, 24) passing through the base end part of the valve disc (18). One end part of each pin member (24) is engaged into the thick portion of the base part (19) of the valve guard (16) while the other end part is engaged into the bottom surface of the receding part (25). Consequently, the valve disc (18) becomes movable in the axial direction of the pin members (24) while on the other hand its rotation is prevented.

Running Operation

Next, the running operation of the rotary type compressor (10) of the swinging type is described below.

When the electric motor (30) is activated, rotation of the rotor (32) is transmitted through the crank shaft (33) to the compression mechanism (20), and the eccentric part (33*b*) rotates. Upon rotation of the eccentric part (33*b*), the piston (45) in movable outside-contact with the eccentric part (33*b*) moves in a sliding motion within the cylinder (40).

As the piston (45) moves in a sliding motion, refrigerant is drawn into the compression chamber (41) of the cylinder (40) from the suction port (50). The drawn refrigerant is compressed in the compression chamber (41). And if the pressure in the high pressure chamber (41*a*) exceeds a back pressure acting on the valve disc (18), then the valve disc (18) deforms towards the valve guard (16) and moves towards the valve guard (16), and moves away from the surrounding area of the outlet opening of the discharge passage (51) which is a valve seat surface. Consequently, the high pressure refrigerant compressed in the compression chamber (41) passes through the discharge passage (51) and is discharged to a space between the compression mechanism (20) and the electric motor (30).

The refrigerant discharged into the space between the compression mechanism (20) and the electric motor (30) flows and passes through a clearance gap defined around the electric motor (30) and then is discharged from the discharge pipe (13).

Other Embodiments

With respect to the above-described embodiments, the present invention may be configured as follows.

Figure 12:
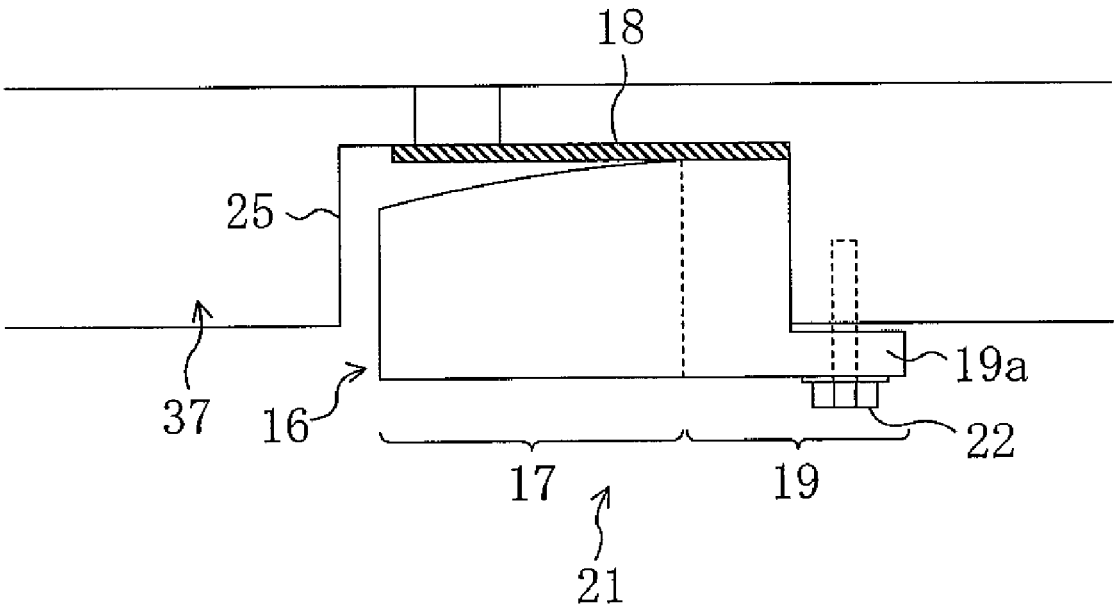
FIG. 12 is a cross sectional view of a discharge valve of a rotary type compressor according to another embodiment of the present invention.

It may be configured such that, without provision of the pin members (24), the base end part of the valve disc (18) is tucked between the valve guard (16) and the bottom surface of the receding part (25) (see FIG. 12). The valve guard (16) is formed such that the step between the thick portion of the base part (19) and the thin fixation part (19*a*) is greater than the depth of the receding part (25). A clearance gap is formed between the fixation part (19*a*) and the back surface of the end plate part (37). As a result of such arrangement, the base end part of the valve disc (18) is strongly tucked between the valve guard (16) and the bottom surface of the receding part (25) by tightening up the bolt (22) in the fixation part (19*a*). Accordingly, since the valve disc (18) is strongly fixed, this makes it possible to control the rotation of the valve disc (18) without having to provide a means for preventing the valve disc (18) from rotation such as the pin members (24). This therefore makes it possible to structurally simplify the discharge valve (21).

Figure 13:
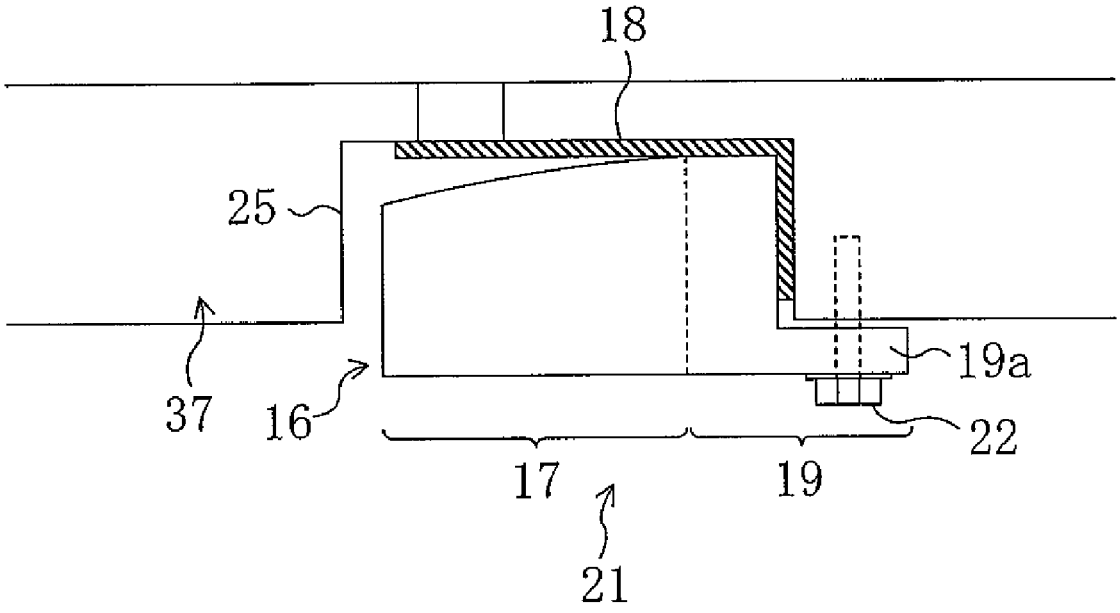
FIG. 13 is a cross sectional view of a discharge valve of a rotary type compressor according to still another embodiment of the present invention.
Figure 14:
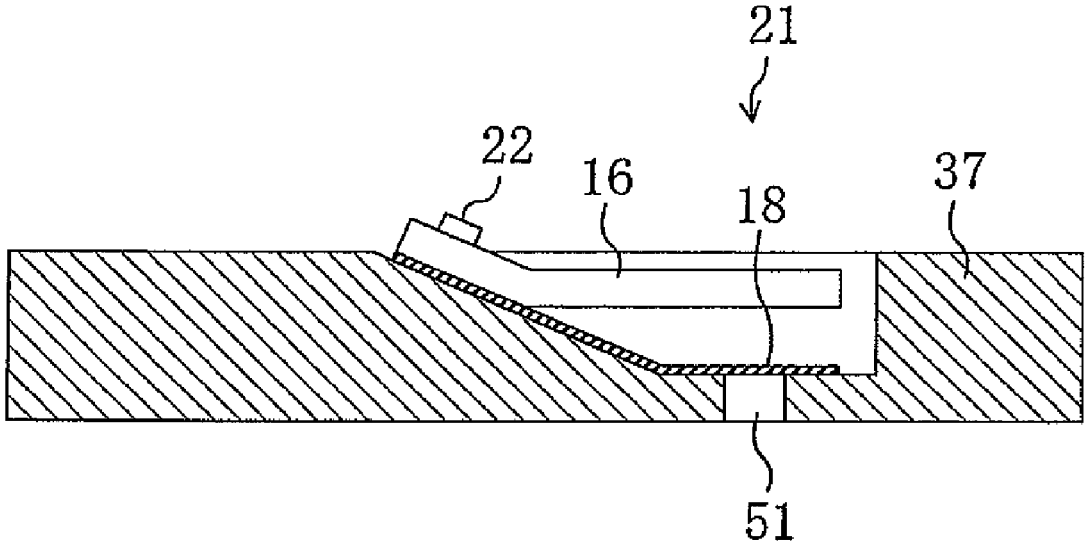
FIG. 14 PRIOR ART
FIG. 14 is a cross sectional view of a conventional rotary type compressor.

In addition, it may be configured such that the base end side of the discharge valve (21) is folded back towards the back surface side to be tucked between the valve guard (16) and the wall surface of the receding part (25) (see FIG. 13). The valve disc (18) is arranged such that it abuts with an area extending from the bottom surface to the wall surface of the receding part (25). This therefore makes it possible that, without provision of any means for preventing the valve disc (18) from rotation (e.g., the pin members (24)), the valve disc (18) is prevented from rotation just by folding back the base end side of the valve disc (18) and then firmly attaching the bent portion to the wall surface side of the receding part (25). This therefore makes it possible to structurally simplify the discharge valve (21).

In addition, it may be configured such that the valve disc (18) is prevented from rotation by use of a pin member (24) of rectangular shape in cross section. In this case, the valve disc (18) is prevented from rotation by provision of a single pin member (24).

In addition, it may be arranged such that the rotary type compressor (10) is installed in a refrigerant circuit which uses refrigerants other than carbon dioxide.

It should be noted that the above-descried embodiments are essentially preferable exemplifications which are not intended in any sense to limit the scope of the present invention, its application, or its application range.

INDUSTRIAL APPLICABILITY

As has been described above, the present invention finds its utility in the field of rotary type compressors configured to compress a fluid in a compression chamber defined by a movable member and a fixed member.

What is claimed is:

1. A rotary type compressor comprising:

a movable member arranged to move in an eccentric motion; and a fixed member which cooperates with the movable member to define a compression chamber arranged such that a fluid drawn into the compression chamber is compressed when the movable member is moved in the eccentric motion;

the fixed member having an end plate part with a front surface facing the compression chamber;

the end plate part being provided with a receding part, which is dented from a back surface of the end plate part, formed on a back surface side thereof, a discharge passage fluidly communicating with the compression chamber and having an opening at a bottom surface of the receding part, and a discharge valve including a reed valve arranged to open and close the discharge passage;

the discharge valve having a plate shaped valve disc with a front surface that abuts with the bottom surface of the receding part and a valve guard arranged to restrict an amount of deformation of the valve disc; and the valve guard having a main body part abuttable with a back surface of the valve disc and a fixation part integrally formed with the main body part and extending externally of the receding part along the back surface of the end plate part, the valve guard being mounted to the end plate part by fixation of the fixation part to the end plate part, the valve disc being entirely located in the receding part, a valve guard surface of the main body part being located nearer to a bottom surface side of the receding part than a front surface of the fixation part, and a space larger than the valve disc in thickness being located between the valve guard surface of the main body part and the bottom surface of the receding part, with the space being formed on an entire surface of the valve disc in the receding part.

2. A rotary type compressor comprising:

a movable member arranged to move in an eccentric motion; and a fixed member which cooperates with the movable member to define a compression chamber arranged such that a fluid drawn into the compression chamber is compressed when the movable member is moved in the eccentric motion;

the fixed member having an end plate part with a front surface facing the compression chamber;

the end plate part being provided with a receding part, which is dented from a back surface of the end plate part, formed on a back surface side thereof, a discharge passage fluidly communicating with the compression chamber and having an opening at a bottom surface of the receding part, and a discharge valve including a reed valve arranged to open and close the discharge passage;

the discharge valve having a plate shape valve disc with a front surface that abuts with the bottom surface of the receding part and a valve guard arranged to restrict an amount of deformation of the valve disc; and the valve guard having a main body part abuttable with a back surface of the valve disc and a fixation part integrally formed with the main body part and extending externally of the receding part along the back surface of the end plate part, the valve guard being mounted to the end plate part by fixation of the fixation part to the end plate part, with the valve guard including a base part having the fixation part, the base part including a step in the boundary between a thick portion of the base part and a thin portion of the base part which includes the fixation part, the thick portion being disposed closer than the thin portion to the main body part, and the valve guard being attached to the end plate part such that a surface of the step of the base part abuts against a wall surface of the receding part.

3. A rotary type compressor comprising:

a cylinder having a ring shaped cylinder chamber;

a ring-shaped piston arranged eccentrically with respect to the cylinder and housed in the ring shaped cylinder chamber such that the ring shaped cylinder chamber is divided into an outer cylinder chamber and an inner cylinder chamber;

a blade disposed in the ring shaped cylinder chamber to divide the outer and inner cylinder chambers into a first chamber and a second chamber; and an end plate part disposed at one side of the cylinder and the ring-shaped piston and having a front surface facing the ring shaped cylinder chamber, the cylinder and the ring-shaped piston being arranged such that a fluid in the ring shaped cylinder chamber is compressed by relative eccentric rotation motion between the cylinder and the ring-shaped portion;

the end plate part being provided with a receding part, which is dented from a back surface of the end plate part, formed on a back surface side thereof; a discharge passage fluidly communicating with the cylinder chamber and having an opening at a bottom surface of the receding part, and a discharge valve including a reed valve arranged to open and close the discharge passage;

the discharge valve having a plate shape valve disc with a front surface that abuts with the bottom surface of the receding part and a valve guard arranged to restrict deformation of the valve disc; and the valve guard having a main body part abuttable with a back surface of the valve disc and a fixation part integrally formed with the main body part and extending externally of the receding part along the back surface of the end plate part, the valve guard being mounted to the end plate part by fixation of the fixation part to the end plate part, the valve disc being entirely located in the receding part, a valve guard surface of the main body part being located nearer to a bottom surface side of the receding part than a front surface of the fixation part, and a space larger than the valve disc in thickness being located between the valve guard surface of the main body part and the bottom surface of the receding part, with the space being formed on an entire surface of the valve disc in the receding part.

4. A rotary compressor comprising:

a cylinder having a ring shaped cylinder chamber;

a ring-shaped piston arranged eccentrically with respect to the cylinder and housed in the ring shaped cylinder chamber such that the ring shaped cylinder chamber is divided into an outer cylinder chamber and an inner cylinder chamber;

a blade disposed in the ring shaped cylinder chamber to divide the outer and inner cylinder chambers into a first chamber and a second chamber; and an end plate part disposed at one side of the cylinder and the ring-shaped piston and having a front surface facing the ring shaped cylinder chamber, the cylinder and the ring-shaped piston being arranged such that a fluid in the ring shaped cylinder chamber is compressed by relative eccentric rotation motion between the cylinder and the ring-shaped portion;

the end plate part being provided with a receding part, which is dented from a back surface of the end plate part, formed on a back surface side thereof, a discharge passage fluidly communicating with the cylinder chamber and having an opening at a bottom surface of the receding part, and a discharge valve including a reed valve arranged to open and close the discharge passage;

the discharge valve having a plate shape valve disc with a front surface that abuts with the bottom surface of the receding part and a valve guard arranged to restrict deformation of the valve disc; and the valve guard having a main body part abuttable with a back surface of the valve disc and a fixation part integrally formed with the main body part and extending externally of the receding part along the back surface of the end plate part, the valve guard being mounted to the end plate part by fixation of the fixation part to the end plate part, with the valve guard including a base part having the fixation part, the base part including a step in the boundary between a thick portion of the base part and a thin portion of the base part which includes the fixation part, the thick portion being disposed closer than the thin portion to the main body part, and the valve guard being attached to the end plate part such that a surface of the step of the base part abuts against a wall surface of the receding part.

5. The rotary type compressor of claim 1, wherein the valve guard includes a base part having the fixation part, the base part includes a step in the boundary between a thick portion of the base part and a thin portion of the base part which includes the fixation part, the thick portion being disposed closer than the thin portion to the main body part, and the valve guard is attached to the end plate part such that a surface of the step of the base part abuts against a wall surface of the receding part.

6. The rotary type compressor of claim 3, wherein the valve guard includes a base part having the fixation part, the base part includes a step in the boundary between a thick portion of the base part and a thin portion of the base part which includes the fixation part, the thick portion being disposed closer than the thin portion to the main body part, and the valve guard is attached to the end plate part such that a surface of the step of the base part abuts against a wall surface of the receding part.

7. The rotary type compressor of claim 1, wherein the discharge valve includes a pin member passing through a base end side of the valve disc to restrict movement of the valve disc.

8. The rotary type compressor of claim 2, wherein the discharge valve includes a pin member passing through a base end side of the valve disc to restrict movement of the valve disc.

9. The rotary type compressor of claim 3, wherein the discharge valve includes a pin member passing through a base end side of the valve disc to restrict movement of the valve disc.

10. The rotary type compressor of claim 4, wherein the discharge valve includes a pin member passing through a base end side of the valve disc to restrict movement of the valve disc.

11. The rotary type compressor of claim 8, wherein a clearance gap is defined between the valve guard and the bottom surface of the receding part, the clearance gap being sized to allow the base end side of the valve disc to move in an axial direction of the pin member.

12. The rotary type compressor of claim 10, wherein a clearance gap is defined between the valve guard and the bottom surface of the receding part, the clearance gap being sized to allow the base end side of the valve disc to move in an axial direction of the pin member.

13. The rotary type compressor of claim 3, wherein a base end side of the valve disc is tucked between the valve guard and the bottom surface of the receding part.

14. The rotary type compressor of claim 3, wherein the valve disc is folded towards the back surface side of the end plate part at a base end side thereof and is tucked between the valve guard and a wall surface of the receding part.

15. The rotary type compressor of claim 4, wherein a base end side of the valve disc is tucked between the valve guard and the bottom surface of the receding part.

16. The rotary type compressor of claim 4, wherein the valve disc is folded towards the back surface side of the end plate part at a base end side thereof and is tucked between the valve guard and the wall surface of the receding part.

* * * * *